United States Patent [19]

Liet

[11] Patent Number: 5,009,219

[45] Date of Patent: Apr. 23, 1991

[54] HEATING DEVICE

[75] Inventor: Fredericus Liet, HD Losser, Netherlands

[73] Assignee: Liets Agrarische Technieken B.V., HD Losser, Netherlands

[21] Appl. No.: 473,107

[22] Filed: Feb. 2, 1989

Related U.S. Application Data

[63] Continuation-in-part of Ser. No. 273,046, Nov. 18, 1988, abandoned.

[30] Foreign Application Priority Data

| | | | |
|---|---|---|---|
| Nov. 20, 1987 | [NL] | Netherlands | 8702795 |
| Dec. 3, 1987 | [NL] | Netherlands | 8072919 |
| Jan. 15, 1988 | [NL] | Netherlands | 8800090 |
| Jan. 15, 1988 | [NL] | Netherlands | 8800091 |
| Jun. 17, 1988 | [EP] | European Pat. Off. | 88.201.266.9 |

[51] Int. Cl.[5] ..... F24B 1/188

[52] U.S. Cl. ..... 126/523; 126/525; 126/527; 126/531; 126/61

[58] Field of Search ..... 126/523, 525, 527, 531, 126/61, 66

[56] References Cited

U.S. PATENT DOCUMENTS

| | | | |
|---|---|---|---|
| 4,166,444 | 9/1979 | Martenson | 126/524 |
| 4,193,387 | 3/1980 | Cline | 126/526 |
| 4,254,757 | 3/1981 | Emmendorfer | 126/522 |
| 4,271,815 | 6/1981 | Johnson | 126/527 |
| 4,280,473 | 7/1981 | Hempel | 126/527 |
| 4,607,612 | 8/1986 | De Risi | 126/525 |
| 4,773,589 | 9/1988 | Boyd | 126/522 |

*Primary Examiner*—Carroll B. Dority

*Attorney, Agent, or Firm*—Watson, Cole, Grindle & Watson

[57] ABSTRACT

The invention relates to a heating device.

A first object of the invention is to embody a heating device with a combustion space having at least one free side, such as an open hearth, or optionally a free-standing heater, such that it possesses a high yield. Another object is the embodying of this heating device such that in addition to use as a free-standing heater it can also be used as insert system for an open hearth. These objects are realized with a heating device characterized by a tilted, substantially U-shaped heat exchanger open to the front for heating air at the fireplace. This heat exchanger being provided with a lower heat exchanger part onto which can be laid solid fuel. For example, a number of pipes laid adjacent to one another, which lower part connects onto a standing heat exchanger part. For example, a number of pipes located at an interval from one another, such that the heat exchanger bounds the combustion space.

10 Claims, 15 Drawing Sheets

HEATING DEVICE

This application is a continuation-in-part, of application Ser. No. 273,046, filed Nov. 18, 1988, and now abandoned.

The invention relates to a heating device.

Heating devices are known in many forms.

A first object of the invention is to embody a heating device with a combustion space having at least one free side, such as an open hearth, or optionally a free-standing heater, such that it possesses a high yield. Another object is the embodying of this heating device such that in addition to use as a free-standing heater it can also be used as insert system for an open hearth.

These objects are realized with a heating device characterized by a tilted, substantially U-shaped heat exchanger open to the front for heating air at the fireplace, this heat exchanger being provided with a lower heat exchanger part, onto which can be laid solid fuel, for example a number of pipes laid adjacent to one another, which lower part connects onto a standing heat exchanger part, for example a number of pipes located at an interval from one another, such that the heat exchanger bounds the combustion space.

Great efficiency is achieved with such a heating device which displays the feature that the standing heat exchanger part consists at least for a significant part of a chamber.

A very high yield is ensured in particular with an embodiment which has the feature that the upper heat exchanger part is placed at a small height above the lower heat exchanger part such that flames emitted by the burning fuel can come into direct contact with that upper heat exchanger part.

A simple construction with a nevertheless high yield is obtained with an embodiment wherein the lower heat exchanger part and/or the upper heat exchanger part comprises a chamber having a wall adjoining the combustion space, through which chamber extends at least one substantially vertical channel that can connect the combustion space to respectively the surrounding air, for the supply of air, and/or to a flue gas discharge.

Particularly, although not only, with the use of roller fans, that is, fans of the type having tangential outflow, care should preferably be taken that the air flows caused by these fans encounter the smallest possible flow resistance. To this end the above described heating device can with advantage have the feature that fan means are connected to the heat exchanger, and that the upper heat exchanger part displays an opening in the form of a pipe, which pipe has an exterior streamline form such that it offers a lessened flow resistance to the through-flowing air.

If the upper heat exchanger part comprises pipes which are located in rows arranged at mutually different levels, the heat exchanging surface area with the flames and/or hot flue gases which pass along the upper pipes is markedly increased, while the passage for the flue gases is substantially not restricted.

A very favourable heat exchanging is obtained if pipes from adjoining rows are fitted staggered to one another. In this case the embodiment is preferred which displays the feature that the horizontal projections of all pipes overlap one another. As a result the flue gases are forced to pass along the pipes in strong heat exchanging contact therewith.

In a heating device whereby the lower heat exchanger part comprises a chamber with a bottom wall and at least one channel, use can advantageously be made of bearing means for slidable carrying of an ash pan.

A preferred embodiment has the characteristic that the bearing means are executed as a compartment with an upper wall and that the compartment is placed in the chamber of the lower heat exchanger part such that the air heated at the combustion space can flow wholly or at least partially around it, such that the combustion air can be fed via the compartment to the combustion space.

In this case the device can also display the special feature that the upper wall of the compartment is also the lower wall of the lower heat exchanger part or forms a part thereof. As an alternative the device can have the characteristic that at least one channel extends between this upper wall and the lower wall of the heat exchanger.

The invention is further related to a heating device with a combustion space having at least one free side, for example an insert system for a fireplace, such as an open hearth, or an optionally free-standing heater, comprising a tilted, U-shaped heat exchanger open to the front for heating air at the fireplace, this heat exchanger being provided with a lower heat exchanger part onto which can be laid solid fuel, for example a number of pipes laid adjacent to one another, which lower part connects onto a standing heat exchanger part, which in turn connects onto an upper heat exchanger part, for example a number of pipes located at an interval from one another, such that the heat exchanger bounds the combustion space.

Such a heating device, which in accordance with the invention is characterized by positioning means for holding in the required position of at least one, in any case a part of the, plate covering off the at least one free side, has the advantage that a user can as required wholly or partially cover the open space inside the heat exchanger.

A variant may serve with advantage wherein the plate is a glass plate. The advantage of such an embodiment is that a user can observe the flames in the combustion space. In the case of a free-standing heating device all the free sides can be covered by a glass plate. In the case however where the heating device is for instance placed in an open hearth, the open sides facing the walls thereof can be covered with metal plates, while the front side is coverable by means of a glass plate.

A very practical embodiment is the one with the characteristic that the positioning means comprise at least one profile part of U-shaped cross section, such that the or each plate is slidable.

The invention is also aimed at a heating device with a combustion space having at least one free side, for example an insert system for a fireplace, such as an open hearth, or an optionally free-standing heater, comprising a heat exchanger, through which can flow air to be heated, for heating air at the fireplace. For the purpose of achieving as high a yield as possible this heating device has the feature that fan means connect onto the heat exchanger.

These fan means are fitted such that cool outside air is drawn in and guided through the heat exchanger, where it is heated and blown out in heated state into the space for heating. Such fan means can in principle be disposed at any required location. Suitable positions are the front side of the heating device, either on the underside of the heat exchanger or the top side thereof, or the standing heat exchanger part, whereby the air is drawn in from the outside of the U-shaped heat exchanger.

Recommended is a variant which has the feature that the fan means are of the electrical type and are mounted flexibly relative to the heat exchanger. Fan means of the electrical type may have the drawback, namely that they cause vibrations which are amplified by the heating device, which normally consists to a large extent of metal, such that they become disturbingly audible, which can be a disadvantage, particularly in a quiet living room. As a result of flexible arrangement relative to the heat exchanger the mechanical coupling between the fan means and the heat exchanger is broken, so that the above mentioned noise nuisance no longer occurs.

It has been found in practice that the best solution is the one characterized in that the fan means are attached to the heat exchanger by means of springs.

An embodiment can also be employed displaying the feature that insulating material is present between the fan means and the heat exchanger.

With respect to the flexible arrangement of the fan means, the insulating material can in this latter case be resiliently compressible. For example mineral wool, such as rockwool, glass wool or the like may be considered for use here. A combination of springs, whether draw springs or pressure springs, and porous, more or less open and loose insulating material may also be used.

The use of insulation material has of course the advantage that to some extent at least it thermally separates the fan means from the heat exchanger. In view of the possibility however that the fan means are not in operation while the heating device is in use, the embodiment may serve in which fan means are removable. In a variant the device can also have the feature that the fan means are disposed in relation to the heat exchanger such that a portion of the cold air flow caused by the fan means serves for cooling of the fan.

A heating device with a combustion space in which fuel can be burned, and to which combustion space is connected a flue gas discharge which runs out into a pipe stump protruding to the outside, can advantageously display the feature that the pipe stump comprises bayonet means for coupling to a flue duct. This ensures a very easy exchanging of the connection to the flue duct, which further improves the flexibility of the heating device.

The invention further relates to a heating device with a combustion space which is partially bounded by pipes extending in at least roughly vertical planes which form part of a heat exchanger and which each possess an opening on the underside for drawing in surrounding air and an opening on the top side for emitting heated air.

Such a heating device is known from U.S. Pat. No. 4,230,090. The heating device disclosed therein comprises a number of curved pipe portions placed in a staggered and interlocked arrangement, which together enclose a substantially cylindrical combustion space.

This known heating device has a number of drawbacks.

Because of the large angle between the intake pipe portion and the discharge pipe portion, the natural convectional flow through the pipe portions is impeded, which results in the yield of the known heating device leaving something to be desired.

The known heating device is furthermore not provided with means for collecting and disposing of solid combustion products.

The construction of the known heating device is relatively complicated. In order to obtain the highest possible yield use is made of a bypass plate which has the purpose of transferring the heat generated in the combustion space in the best possible manner to the air flowing through the pipes.

The known heating device is further executed such that only the cylindrical peripheral wall forms part of the heat exchanger. The front wall is formed by a door, but the rear wall remains unused, which has heat loss as a consequence.

The invention now has for its object to embody a heating device such that is has a very high yield, that it heats up a space very rapidly and uniformly, and as a result of its simple construction can nevertheless be manufactured at low cost. The invention further aims to execute a heating device such that solid combustion products, such as ash, can easily be collected and discharged.

In order to achieve the above stated objects the invention proposes in general to embody a heating device of the type referred to in the preamble such that each pipe displays a straight, at least roughly vertical portion.

Use is preferably made of a variant wherein on the upper sides of at least a number of vertical pipe portions there connects a second pipe portion extending above the combustion space. The second pipe portion may have a straight or curved form and may be disposed horizontally or at an inclination.

A particular embodiment is characterized by two groups of pipes, of which the vertical pipe portions form part of walls of the heat exchanger located opposite each other, of which group of pipes the second pipe portions are in interlocked position.

In another embodiment the heating device displays the special characteristic of a group of by and large U-shaped pipes, whereby the legs of the U are the vertical pipe portions and the body of the U has at least one blow-cut aperture, such that these pipes form part of walls located opposite each other and the upper surface of the heat exchanger.

These U-shaped pipes can be welded to one another directly or via sheet strips.

Attention is drawn to the fact that the heat exchanger must offer the possibility for passage and if necessary guided discharge of flue gases and other combustion products.

A heating device of the above specified type preferably displays the special feature that a further group of pipes connects on the second portion of an outermost pipe. Thus achieved in this latter embodiment is that that wall portion also forms part of the heat exchanger and therefore participates in the heat recovery process.

In a particular embodiment the heating device can display the characteristic that the above mentioned additional group of pipes comprises exclusively straight pipe portions.

It has been found that the best results are achieved with this latter embodiment if the straight pipe portions have a small angle of slope such that they extend a little above the bottom of the combustion space.

In a preferred embodiment a base plate is used, through which the lower ends of the vertical pipe portions extend.

In the combustion space a grate can be placed for carrying the fuel. For the disposal of the solid combustion products, such as ash, an ash pan placeable beneath the carrying grate can be employed with advantage.

A practical embodiment is the one wherein the combustion space is accessible via a door.

A very simple embodiment is the one in which the ash pan is provided with air supply openings. The door can in this case have a comparatively simple construction, and the air supply openings are placed in a relatively cool part of the heating device. It is noted in this respect that the heating device known from U.S. Pat. No. 4,230,090 has an air supply valve which is arranged in the door and therefore subjected to very high temperatures.

In preference use is made of a housing encasing all pipes and having at least one passage opening for allowing passage of heated air. Such a housing has the advantage of enclosing the pipes and other, for instance plateform, interpositioned parts of the heat exchanger that are very hot during use of the heating device, so that risk of injury from burning is lessened.

In the case of a housing use can be made of a flue gas discharge connecting thereto, which can in particular communicate with the space between the rear wall of the housing and straight pipe portions of the additional group of pipes.

An enlarged capacity can be obtained by employing forced convection instead of the natural convection described up until this point. An embodiment based thereon is characterized by at least one air chamber connecting onto the openings for the supply of outside air, which chamber is provided with blowing means for drawing in outside air and the feeding thereof to the pipes.

The invention will now be elucidated with reference to the drawing of two embodiments. In the drawing.

Figure 1:
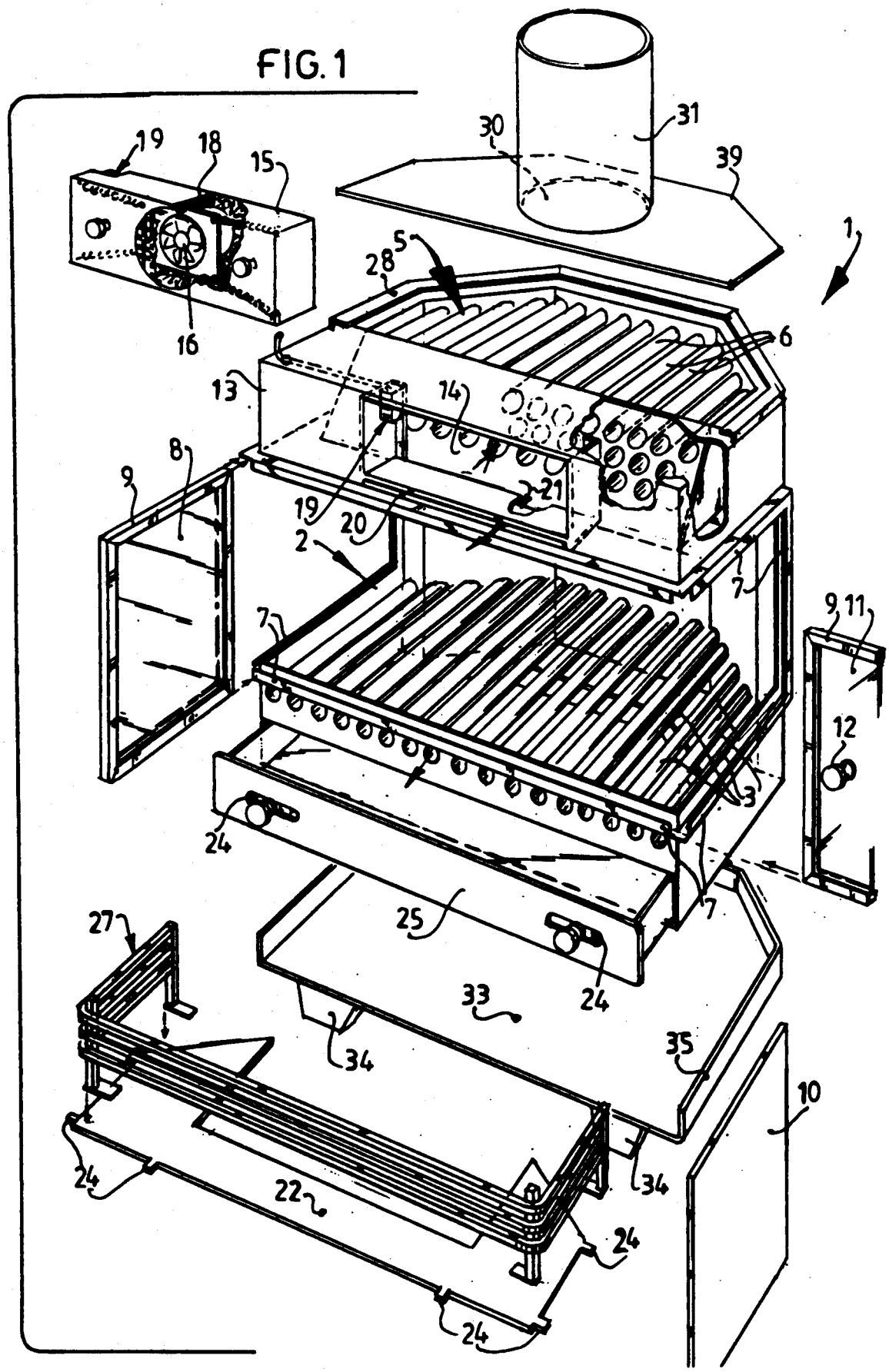
FIG. 1 shows a perspective view of a heating device according to the invention, whereby for the sake of clarity the component parts are shown slightly interspaced from one another.

FIG. 1 shows a heating device 1. This comprises a tilted, U-shaped, i.e. C-shaped, heat exchanger open to the front, which comprises a lower heat exchanger part 2, onto which can be laid solid fuel, this lower heat exchanger part 2 comprising a number of pipes 3 laid adjacent to one another with mutual interspacing. Connecting onto these pipes 3 is a standing heat exchanger part 4 which in this embodiment is double-walled and thus comprises a chamber or hollow space. Onto the part 4 connects an upper heat exchanger part 5 which comprises pipes 6.

The device 1 bears a number of steel profiles, all designated by 7 and of C-shaped cross section. These serve for slidable attachement of plate parts to the device. Located on the left-hand side in this embodiment is a glass plate 8 enclosed by a metal buffer edge in the form of a frame 9, while present on the right-hand side is a steel covering plate 10. Present on the front is a glass plate 11 with a hand-grip 12 which covers the open front of the device 1 and which can be slide out, for example for the introduction of fuel.

The pipes 6 connect onto a blow-in chamber 13 with a space 14 for the insertion of a fan unit 15. Suspended herein by means of slack draw springs 17 is an electrically drivable fan 16. The fan 16 is further surrounded by insulation material 18. The fan unit 15 is a plug-in unit and can be connected to an electrical terminal 19 present in the space 14.

It is remarked that as required it may only be possible to partially slide or swing out the fan unit 15.

Connecting to the space 14 is the blow-in chamber 13, to which the pipes 6 connect. Also connecting to space 14 is a cooling channel 20, through which a part of the air flow caused by fan 16 can be guided in the direction of arrows 21. The cooling channel 20 is situated therefore between fan 16 and the upper face on the inner side of the heat exchanger 2, 4, 5, which results in the fan effectively cooling itself.

Laid on the pipes 3 in the embodiment as in FIG. 1 is a heat resistant plate 22 which comprises a number of spacers 24. The configuration is such that plate 22 has a form adapted to the form of the surface of the lower heat exchanger part 2. Use of plate 22 prevents flames from the burning fuel touching the glass plates 8 and 11 directly, which can result in soot-staining. Strictly speaking, soot-staining of the steel plate 10 is not significant; the plate 22 could therefore also be formed in this embodiment such that the right-hand portion of plate 22 were absent.

Figure 2:
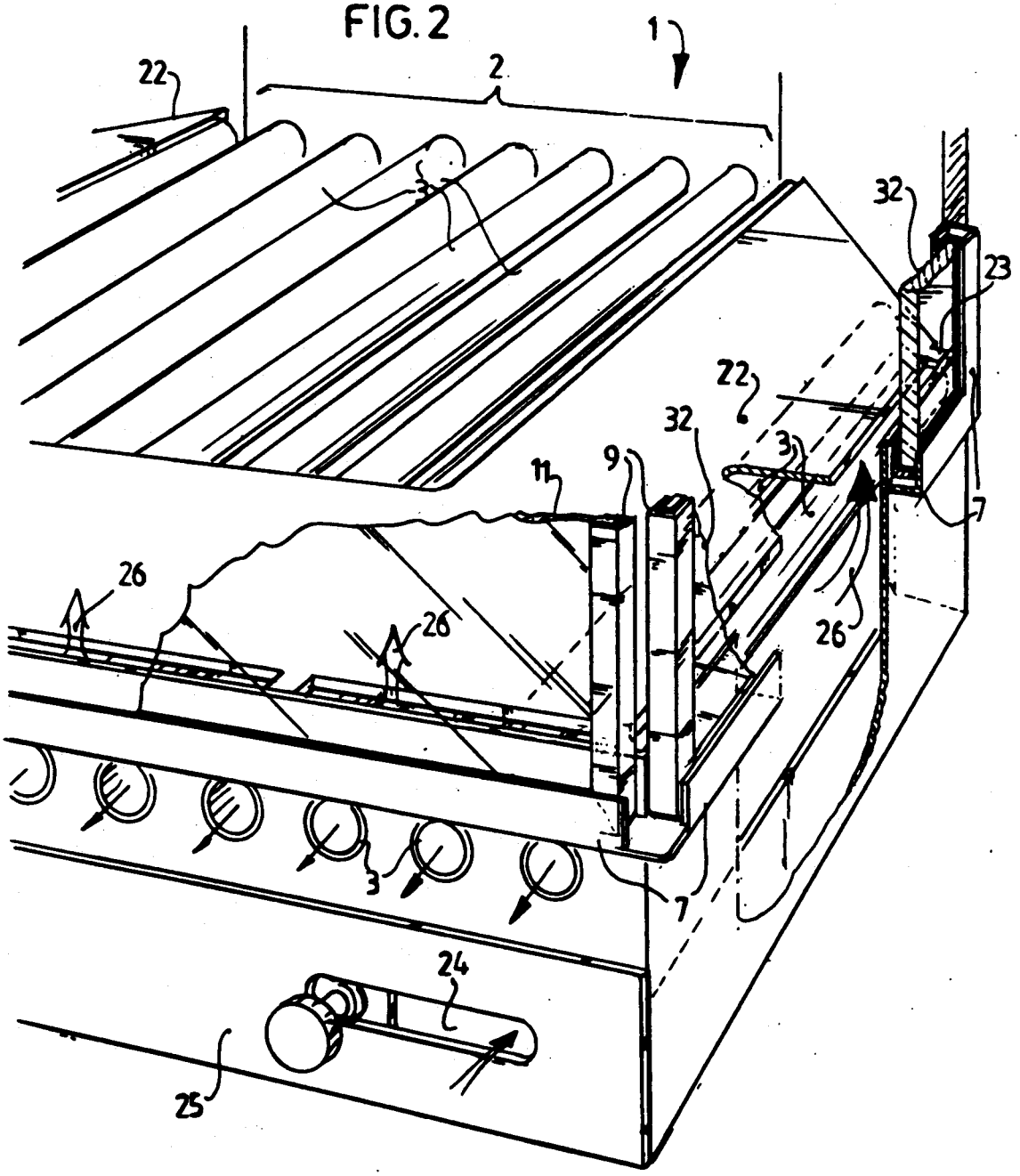
FIG. 2 shows a partly broken away perspective view of a detail of the device as in FIG. 1.

The spacers 24 serve to ensure that the pre-heated air passed via air inlet openings 24 into an ash pan 25 can be guided along the glass plates 8, 11. FIG. 2 shows this air with arrows 26.

Placed on plate 22 is a bar rail 27 which serves to hold in fuel.

A five-sided profile piece 28 connects to the upper heat exchanger part 5. This serves for slidable receiving of a similarly formed cover plate 29 with a through-hole 30, onto which connects a flue gas discharge pipe stump 31.

FIG. 2 shows the construction of the heating device 1 in some detail. In the configuration of FIG. 2 the steel plate 10 is replaced by a glass plate 32.

For an application where the heating device 1 has to be used free-standing in a space, use can advantageously be made of a more or less tray-like carrying plate 33 having a number of floor supports or legs 34. The carrying plate 33 displays an upright edge 35 which is absent at the front, thus enabling sliding out of the ash pan 25.

Figure 3:
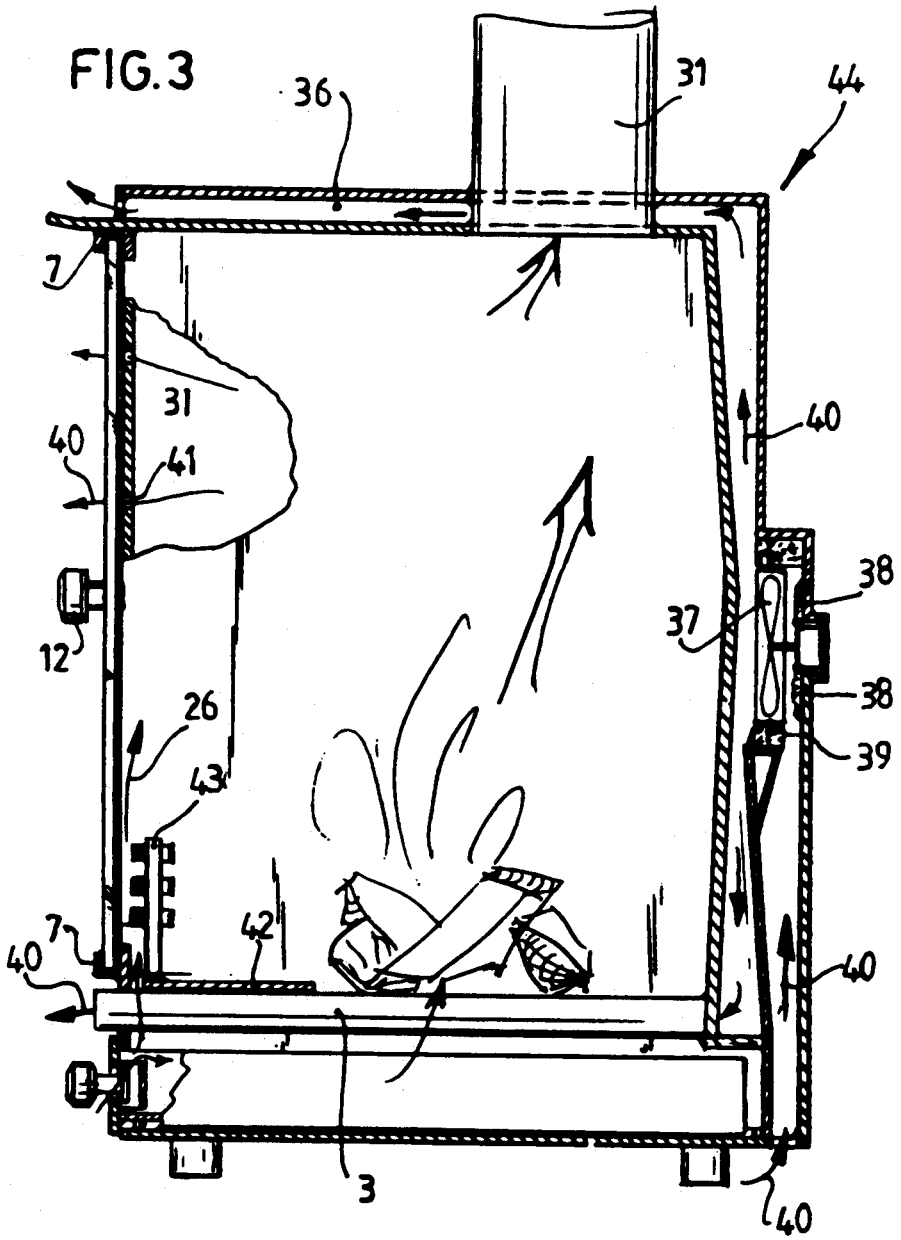
FIG. 3 shows a cross section through a variant.

FIG. 3 shows a heating device 44. This device comprises an upper heat exchanger part 36 in the form of a chamber. A fan 37 is situated at the rear of the device. The fan is suspended by means of springs 38 and sealed by means of insulation material 39. Arrows 40 show the flow of the air to be heated by the heating device.

In the embodiment according to FIG. 3 the side walls of heating device 1 take the form of hollow chambers similar to the chamber 36 and have on the front blow-out apertures 41. Only the front part of heating device 44 is covered by the glass plate 11.

A plate 42 is placed on the pipes 3 at the front. This plate 42 is constructed in the same way as the front of the plate 22 as in the FIGS. 1 and 2. Welded into position on plate 42 is a bar rail 43.

Attention is drawn to the fact that the above described features of the invention can be applied in virtually any type of heating device in which fuel such as wood, coal, oil or gas, is burned.

With respect to heating devices of the type with a tilted, U-shaped heat exchanger open to the front, it is remarked that a heating device can also be used in which the upper part of the heat exchanger comprises no pipes but a through-flow chamber of for instance rectangular cross sections over the whole width of the combustion space, which flow chamber may have a closed cylinder-shaped space for passage of flue gases to a flue gas discharge such as the flue gas discharge pipe stump 31 shown in FIG. 1. Without further provisions the danger would exist in such an embodiment that the flames would exit directly via the discharge, which would have an adverse effect on the yield of the heating device. In order to cope with this a plate can be positioned beneath the connection of the discharge to the combustion space, which results in the flames being diverted such that they can first give off a significant part of their heat to the heat exchanger.

It is stressed that in the case of an embodiment with the specified C-shaped heat exchanger the greatest amount of heat can be extracted at the lower part of the heat exchanger.

It is further noted that a grate may also serve to carry solid fuel, whereby a heat exchanger is employed for instance which comprises only a vertical rear part and an upper part. Wholly analogous to that described with respect to the plate 22 an embodiment can serve in this context whereby only in a portion of the bottom of the combustion space is oxygen passage to the fuel possible. A grate for carrying fuel may thus comprise a number of heat exchanger pipes and on the sides a fixed plate or one more through-flow chambers.

Figure 4:
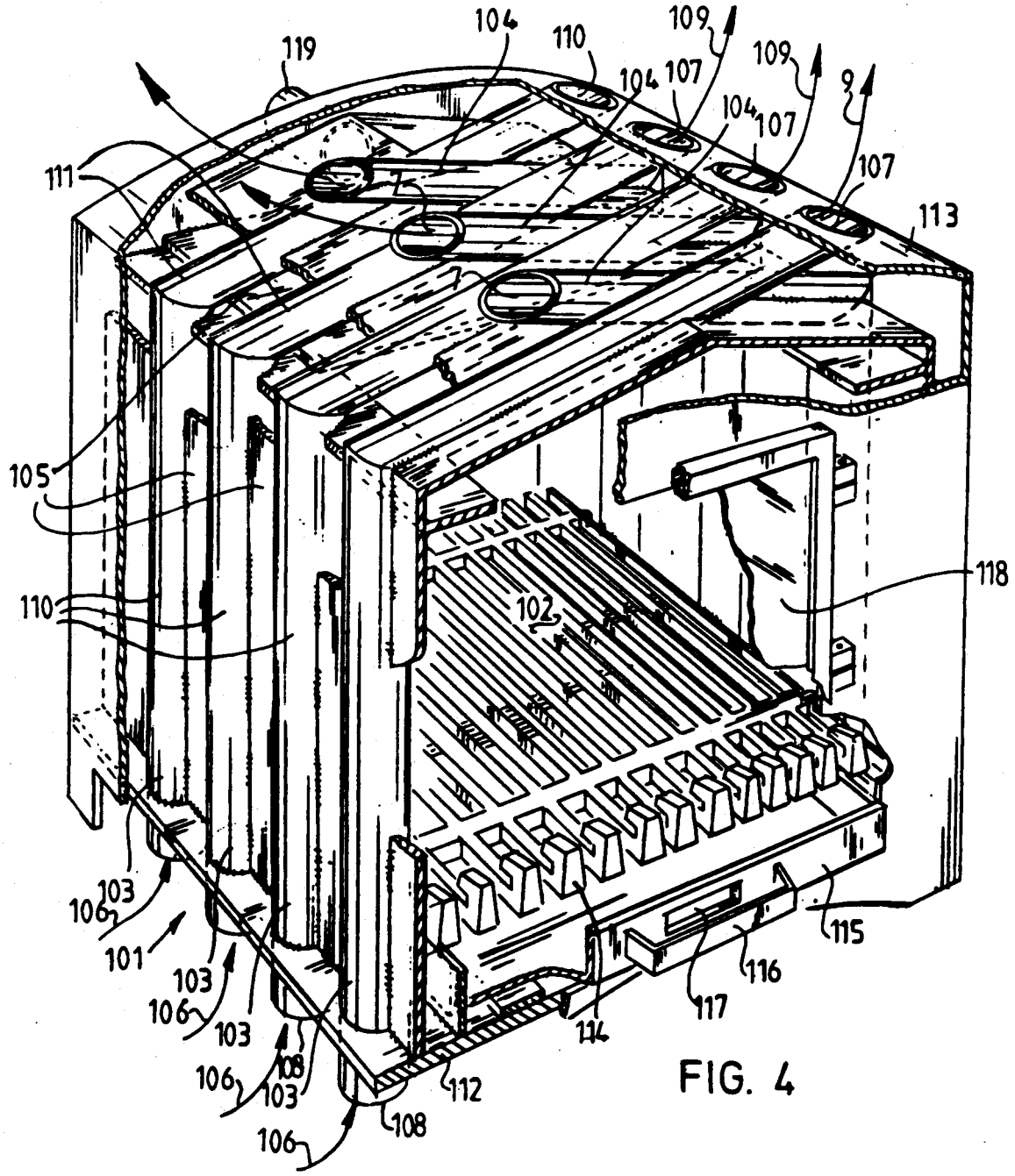
FIG. 4 is a partly broken away perspective view of a further embodiment.

FIG. 4 shows a heater 101 in a first embodiment of the invention. This has a combustion space 102 which is partially bounded by a group of four pipes 103 and a group of three pipes 104 which form, together with plate portions 105 arranged berween, a heat exchanger and which each display an opening 108 on their underside for drawing in as according to arrows 106 of outside air and which have at the top an opening for emitting heated air as according to arrows 109.

Each pipe 103, 104 comprises a straight vertical portion 110 and connecting thereto a straight, sloping pipe portion 111 extending above the combustion space 102.

The pipes 103, and the pipes 104 form groups, of which the inclining pipe portions 111 are placed interlocking in the manner shown.

The heater 101 further comprises a base plate 112 through which the lower ends of the vertical pipe portions 110 extend. Additionally arranged over this base plate 112 is a housing 113 of sheet metal, through which the top ends of the sloping pipe portions 111 extend.

In the combustion space 102 is situated a grate 114 for carrying fuel. Located beneath this grate 114 is an ash pan 115 which is provided with a hand-grip 116 and an air supply opening 117. Partly drawn is a door 118, using which the combustion space is accessible and with which it can be closed off.

The housing 113 is completely closed on the rear side facing the door 118. Connecting onto housing 113 is a flue gas discharge 119.

Figure 5:
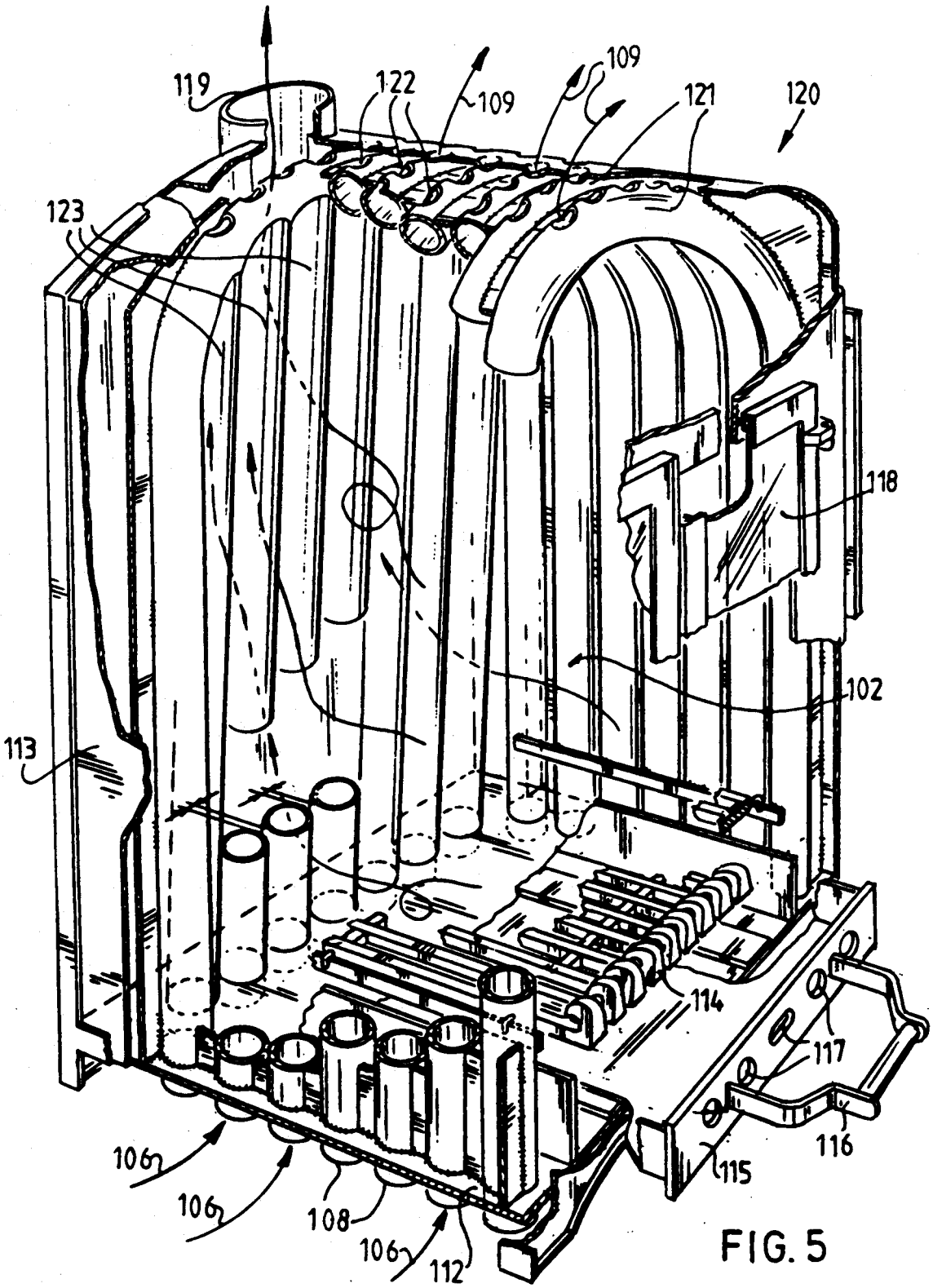
FIG. 5 shows a partly broken away perspective view of a further embodiment.

FIG. 5 shows a further embodiment 120. This heater 120 comprises a group of seven substantially U-shaped pipes 121, whereby the legs of the U run in substantially vertical direction and the body of the U, that is, the curved top part, displays five blow-out apertures 122. Connecting onto the rear pipe 121, that is, the pipe furthest removed from the door 118, are another seven straight pipes 123 disposed in a vertical plane and sloping very slightly forward. As a results of this construction a space exists between the vertical rear wall of housing 113 and the straight pipes 123. This enables the vertical flue gas discharge as shown in FIG. 5.

Attention is drawn to the fact that components as in FIG. 5 are designated with the same reference numerals as functionally corresponding parts in FIG. 4.

Figure 6:
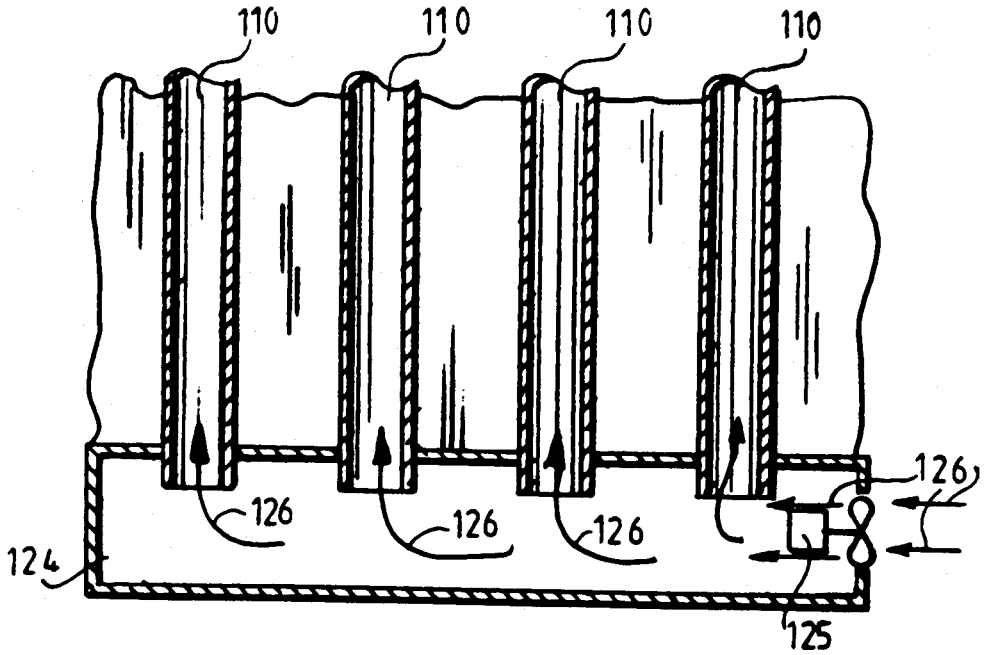
FIG. 6 shows a partly cross sectional view of a variant of the heating device according to FIG. 4.

FIG. 6 shows a detail of a variant of the heater 101 as in FIG. 4. This embodiment is furnished with an air chamber 124 with an intake fan 125, which air chamber 124 communicates with the feed openings, that is, the bottom ends of the vertical pipe portions 110. The flow of the air is indicated with arrows 126. As a result of this forced convection the capacity of the heater can be further enlarged.

It will be apparent from the foregoing that the invention offers a heater which combines great ease of operation with low and a high yield.

Figure 7:
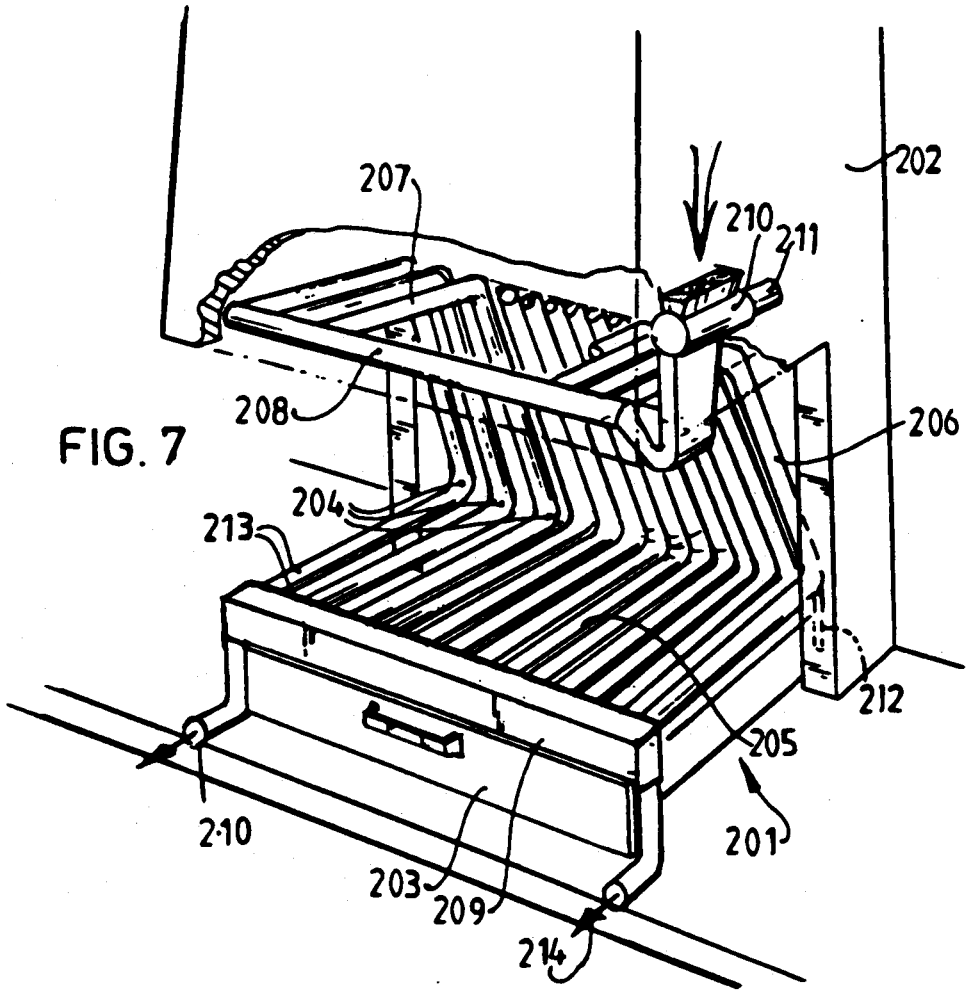
FIG. 7 is a partly broken away perspective view of a further embodiment.

FIG. 7 shows a space for an open hearth 201 above which is arranged a chimney cap 202. The open hearth 201 comprises an ash pan 203 arranged beneath a series of tilted U-shaped bent hollow pipes 204 open towards the front. Each of the pipes 204 consists of a bottom pipe 205, a standing pipe 206 and a top pipe 207. The pipes are each fitted with a space between them. The interspacing between the bottom pipes 205 serves to allow passage of ash to the ash pan 203 and to draw oxygen to the fireplace. Each of the top pipes 207 communicate with a tubular air chamber 208 which extends transversely of the C-shaped bent pipes 204. The bottom pipes 205 run out into a lower air chamber 209 extending transversely thereof. Both ends of the lower air chamber 209 are curved to adapt the contour of chamber 209 to the form of the open hearth and end in an outflow opening 210.

The upper air chamber 208 is closed off on one side and provided on the other with a fan 210 driven with an electro-motor 211. The whole of the heat exchanger 201 rests on the bent ends of the lower air chamber 209 and on the other side on the rear legs 212.

The insert system with the heat exchanger 201 works as follows. The fan 210 draws air in and the indrawn air is fed via the upper air chamber 208 to the top pipes 207, wherein the air is heated with the flue gases passing through at that point. Descending via the standing pipes 206 and via the first portion of the lying pipes 205 the air is maximally heated during passage through the fireplace. The maximally heated air is collected in the lower air chamber 209 and flows as heated air 214 via the outflow openings 210 into the room.

The heat transfer from the fireplace via the heat exchanger 201 to the air flowing through heat exchanger 201 takes place in three steps. A first heating step with the flue gases in the top pipes 207, a second heating step by radiation in the standing pipes 206 and a final, maximum temperature increase through contact with the fire and/or flames at the location of the fireplace, mainly in the bottom pipes 205. Thus occurs a heat transfer with a continual, higher, applied outer temperature.

Figure 8:
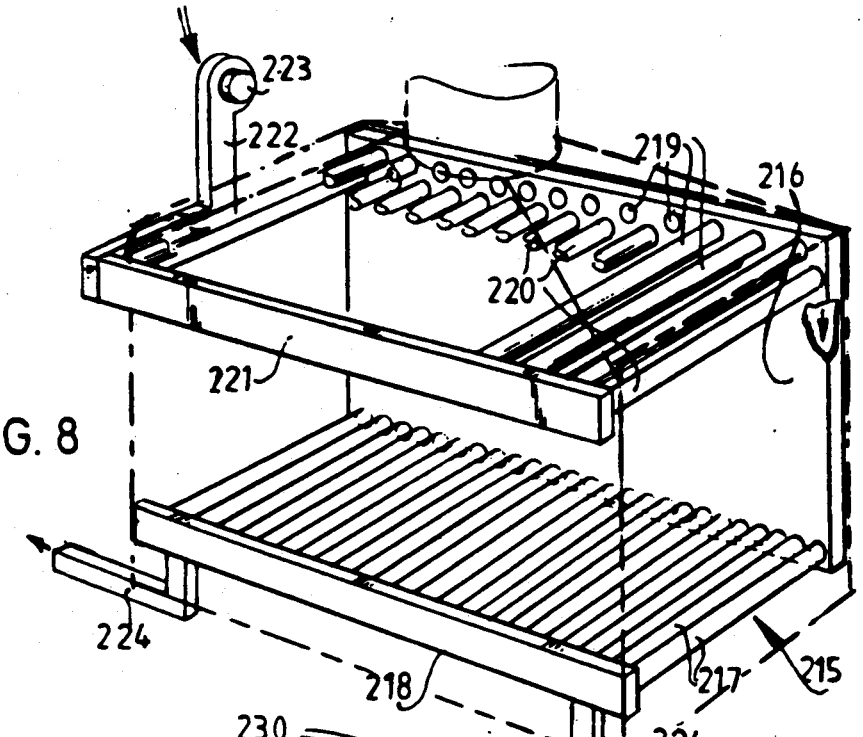
FIG. 8 shows a partly broken away perspective view of a further embodiment having a heater jacket indicated with dashed lines.

FIG. 8 shows a second embodiment of the insert system 215 according to the invention which in this case is placed in a heater jacket indicated with dashed lines. The heat exchanger in this case comprises a standing, hollow rear wall 216 which is formed by two plates which are disposed opposite each other and joined to each other at the edges. The bottom, lying pipes 217 and the top, lying pipes 219 and 220 connect onto the hollow rear wall 216.

At the front the bottom pipes 217 run out into a lower air chamber 218 which is joined to a duct 224 which connects up to another heating system (not shown), for instance for heating other rooms.

In this case the top pipes are arranged in rows at different levels, whereby the pipes 220 of the lower row are arranged in staggered manner relative to the pipes 219 of the upper row.

Connected via an air supply duct 222 onto the upper air chamber 221, which communicates with the lower row of pipes 220 as well as the upper row of pipes 219, is a fan 223. Fan 223 draws in air which is transported through the pipes 219 and 220 and passes the hollow wall 216 in downward direction, and which after heated to the maximum in the fireplace is discharged via the ducts 224.

Figure 9:
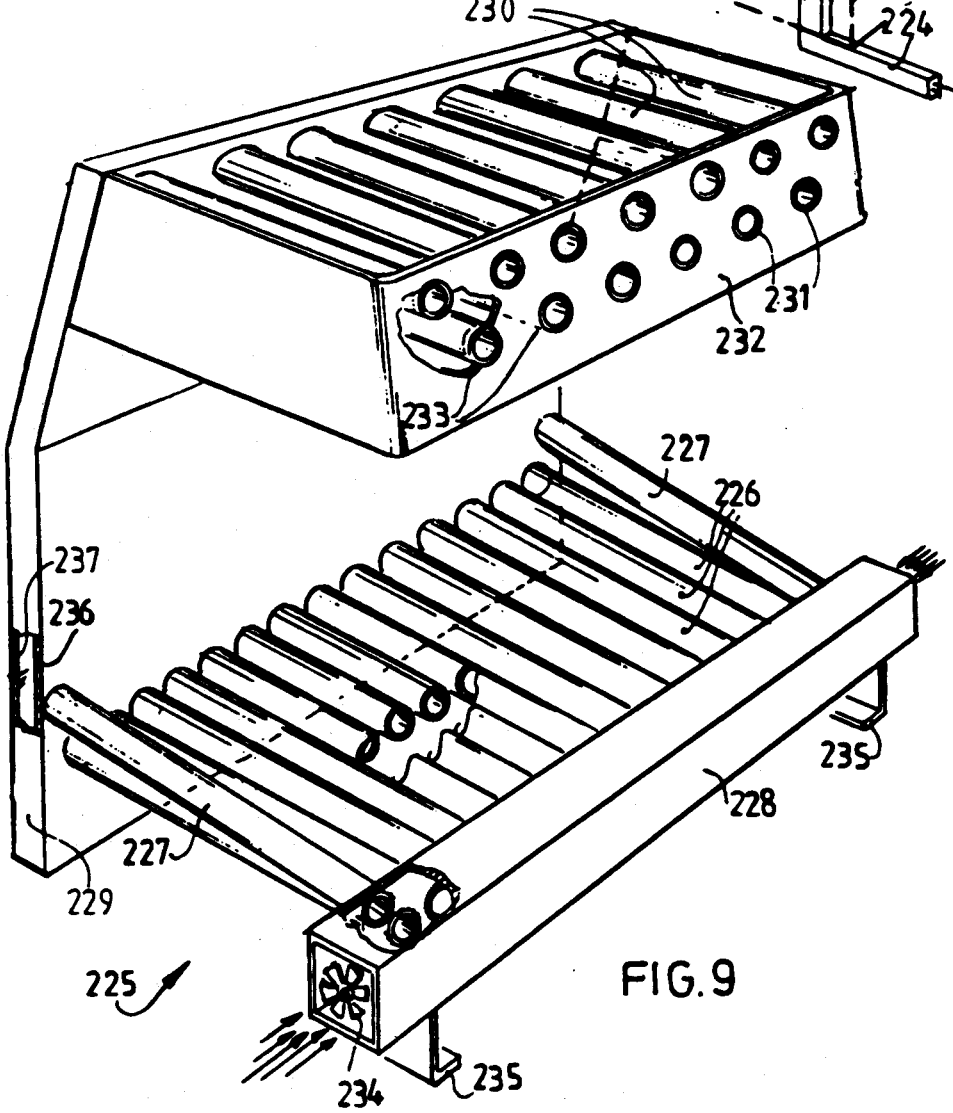
FIGS. 9, 10 and 11 show other further embodiments of the device according to the invention.

FIG. 9 shows another insert piece according to the invention, whereby the heat exchanger 225 is built up from bottom pipes 226 which connect on one side to the lower air chamber 228 and on the other to the hollow rear wall 229. The upper pipes 30 and 31 once again arranged in rows and in staggered position to one other connect on one side to the hollow wall 229 and on the other side protrude through passages 233 arranged in a bracket 232 attached to the rear wall. Connecting onto the underside of the hollow rear wall 229 are pipes 227 that are arranged elevated in relation to the bottom pipes 226, whereby the seat of the fire is held in position.

A fan 234 arranged in the air chamber 228 draws in air which then passes via the pipes 226 and 227, the hollow wall 229 and the pipes 230 and 231 and is blown thus heated into the room.

The hollow rear wall 229 serves in this case also as support for the heat exchanger 225 and angular legs 235 are arranged underneath air chamber 228.

It is further remarked that the plates 236 and 237 forming the hollow wall 229 are angular so that the hollow rear wall 229 inclines forward at least partially.

Figure 10:
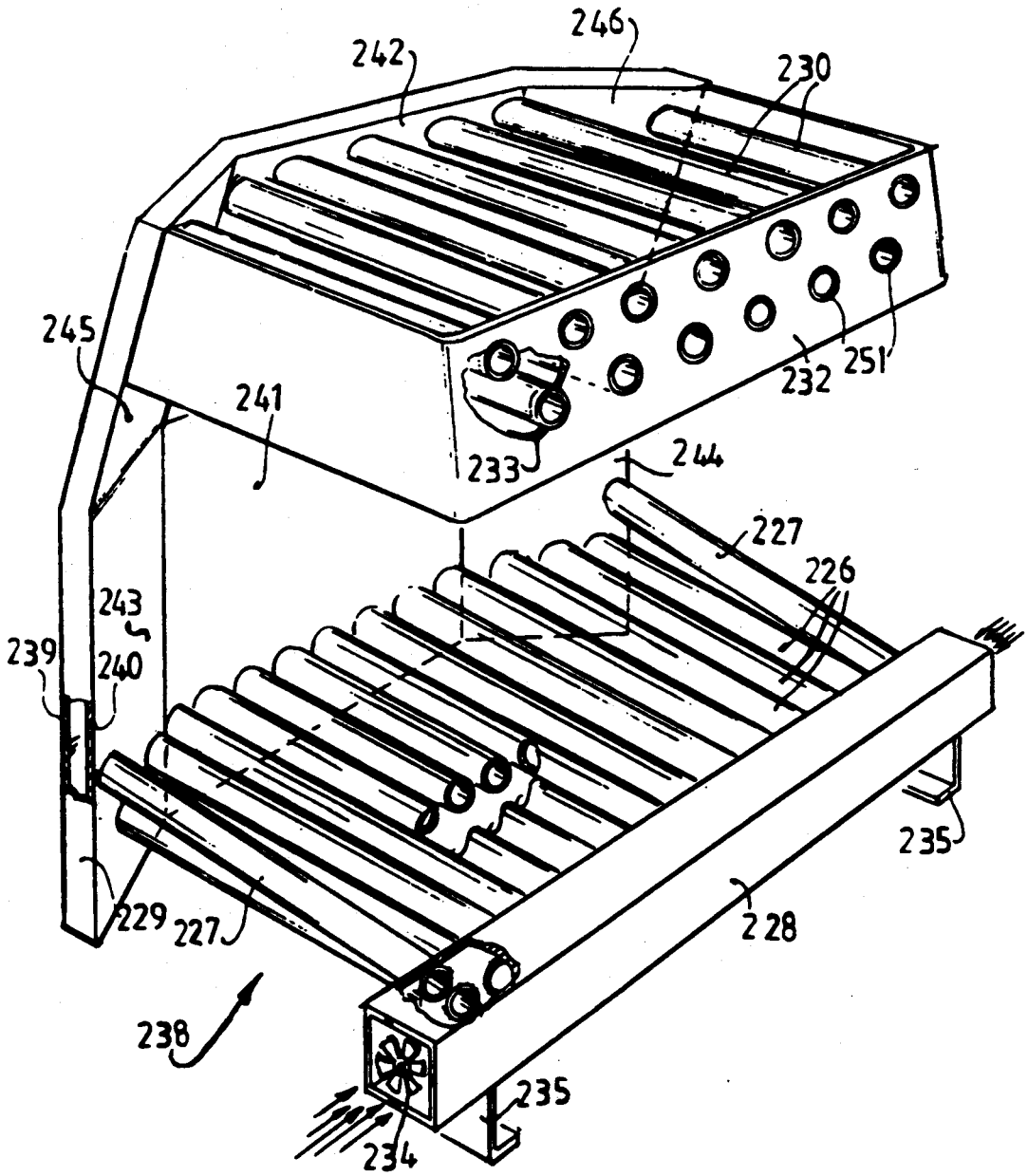

FIG. 10 shows a fourth embodiment of the insert piece according to the invention, whereby the heat exchanger 238 corresponds substantially with heat exchanger 225 from FIG. 3, and corresponding construction details are designated with the same reference numerals.

The only difference is that the hollow rear wall 229 is constructed from the plates 239 and 240, which are built up of a central portion 241 having an angular, forward inclining upper part 242, and two lateral portions 243 and 244 which are bent forward in relation to the central portion 241 and each provided with a forward inclining part 245 and 246 respectively. The pipes 230 and 231 connect onto the forward sloping parts 242, 245 and 246.

The rear wall in this way acquires bevelled corners and can be more easily placed in existing positions.

Through the presence of the lateral portions 243, 244 the insert system is found to improve in yield. The fire can be effective over a greater peripheral angle without any occurrence of disturbing smoke production.

Figure 11:
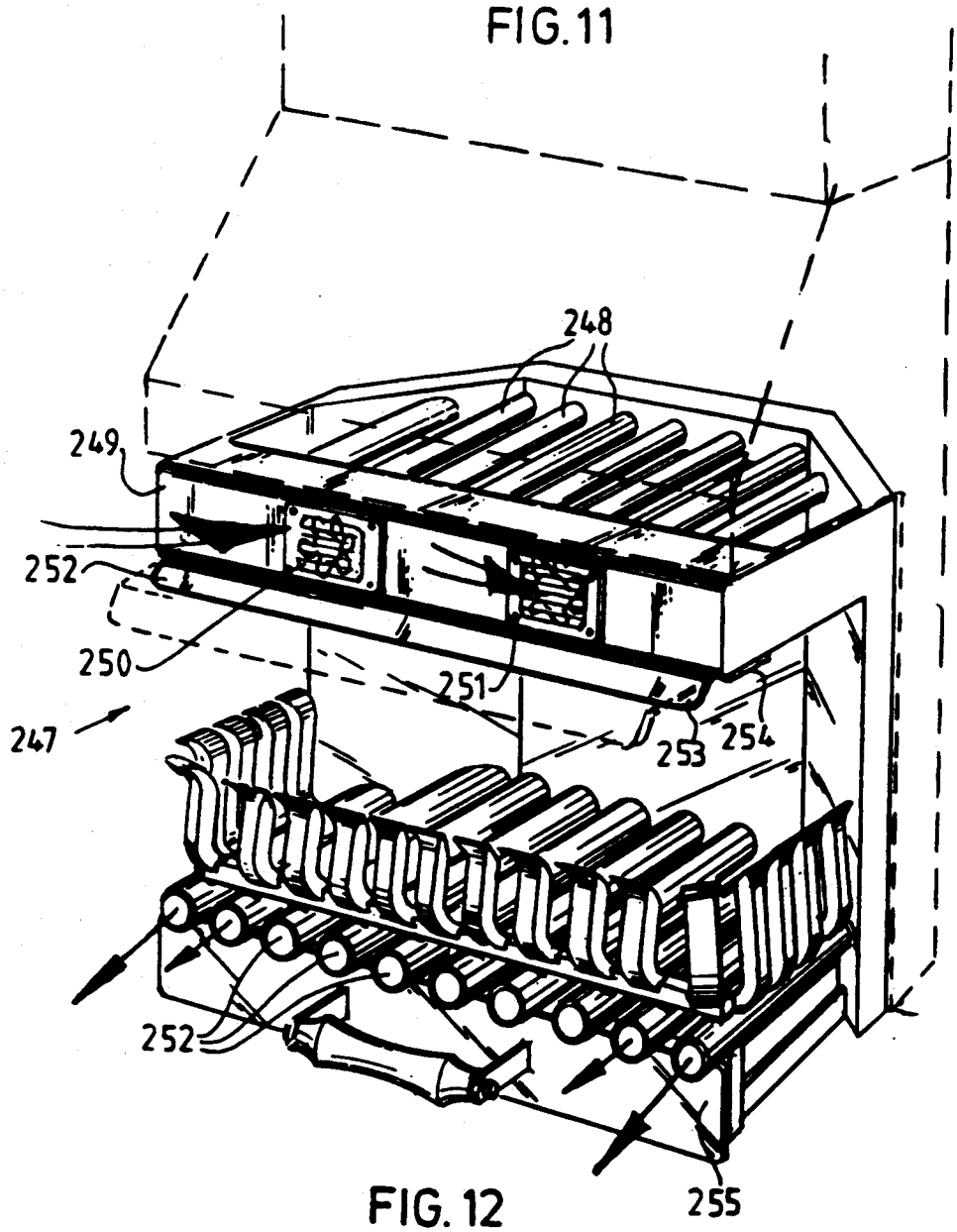

FIG. 11 shows an insert system 247 wherein the forward facing ends of the top pipes 248 connect onto an air chamber 249, on which are fitted two suction fans 250, 251. These fans 250, 251 are arranged on the forward face of air chamber 249. In order to prevent the fans 250, 251 drawing in flue gases and other combustion products and blowing them out via the free front ends of the bottom pipes 252 into the space for heating, in this embodiment a forward extending, heat resistant strip 252 with a leading edge 253 hanging down at a slant to the front is arranged under the intake side of the fans 250, 251. This is fastened to clamps 254. The distance forward over which the strip 252 extends is as a result adjustable. This ensures that even under the most variable conditions no combustion products are drawn in through the fans 250, 251, while the relevant setting can moreover be made by a specific user such that the insert system gives the most aesthetic satisfaction.

A removable ash pan 255 is connected on below the bottom pipes 252.

Figure 12:
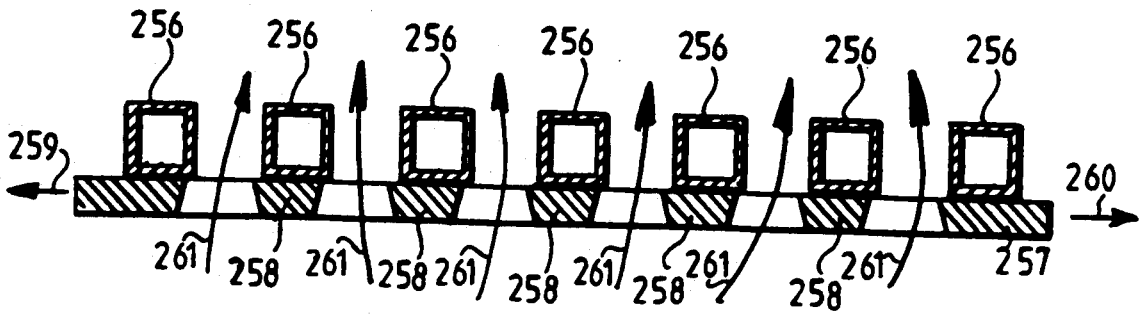
FIG. 12 is a cross section through a detail of a variant.

FIG. 12 shows a detail of a variant. The bottom pipes 256 here take a rectangular form. Extending beneath these pipes 256 is a grate 257 with bars 258. As indicated with the arrows 259 and 260 the grate is reciprocally slidable by generally known means, which are therefore not designated further. The dimensioning of the pipes 256 and bars 258 of grate 257 is such that grate 257 can be adjusted berween two extreme positions, in one of which it leaves the free space between pipes 256 wholly free for the passage of air, as is indicated with arrows 261, and in the other of which the bars 258 almost completely close off the gap between pipes 256, which results in the air supply via these pipes 256 being almost completely shut off. It will otherwise be apparent That even in the closed position the oxygen supply is never completely blocked, since it does not in any case take place only via the gaps between pipes 256. Such an arrangement offers the user the possibility of controlling the fire such that the flames can never rise above the top pipes 248, which would in any case have an adverse effect on the efficiency of the insert system.

Although not discussed in as many words, it will be apparent that the pipes through which the air for heating flows can be circular round or elongate in vertical height, whereby a still greater heat exchanging surface area is provided. In addition, means can be connected to the air chambers and/or to the diverse air pipes with which the air supply and flow through the pipes can be controlled.

Figure 13:
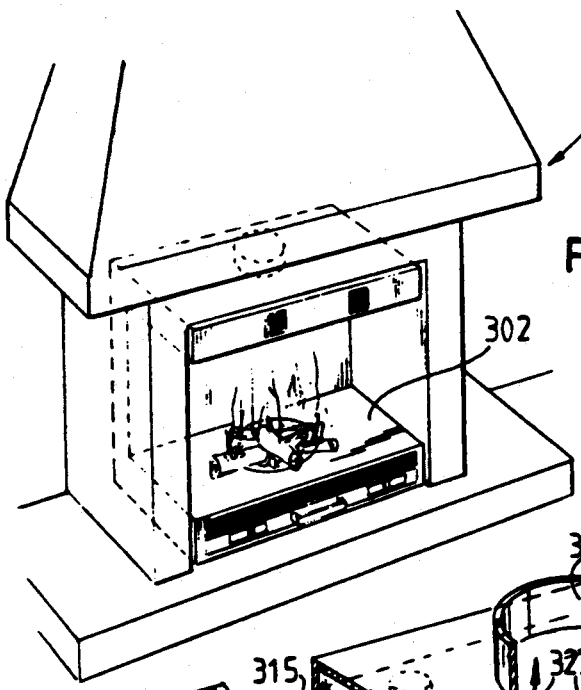
FIG. 13 is a perspective view of an open hearth in which is placed a heating device according to the invention.

FIG. 13 shows an open hearth 301 wherein is placed a heating device 302 according to the invention. The heating device 302 in this case takes the form of an insert system.

Figure 14:
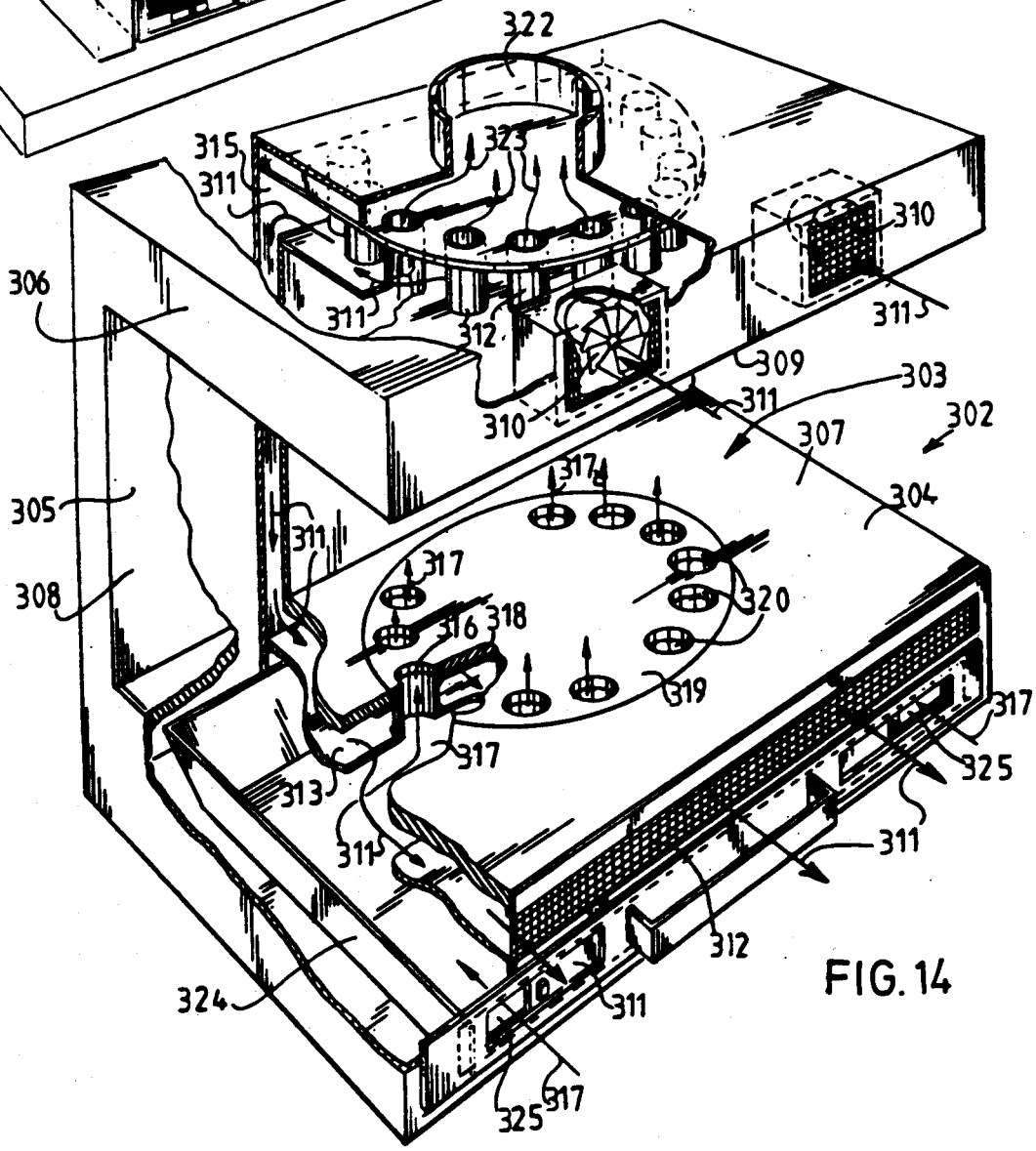
FIG. 14 shows a partly broken away perspective view of a further embodiment.

FIG. 14 shows the heating device 302 in more detail. It comprises a combustion space 303 bounded on three sides by a tilted U-shaped heat exchanger open to the front having a lower heat exchanger part 304 on which can be laid solid fuel and which is joined to a standing heat exchanger part 305 which in turn connects to an upper heat exchanger part 306.

The heat exchanger parts 304, 305 and 306 each take the form of a chamber with the respective walls 307, 308, 309 contiguous to the combustion space 303.

Connecting to the upper part 306 are two fans 310 for the sucking in of surrounding air. As designated with the arrows 311 the sucked in air is blown by the fans 310 successively through the upper heat exchanger part 306, the standing part 305 and the lower part 304, where the then heated air leaves the heating device 302 via a grid 312.

The chambers of the lower part 304, the standing part 305 and the upper part 306 are designated 313, 314 and 315 respectively.

In this embodimet twelve pipes 316 extend through the chamber 313 and connect the combustion space 303 with the environment for supply of air to the combustion space 303, as is indicated with arrows 317. Pipes 316 debouch into a round, recessed portion of the wall 307. Lying in this portion 318 is a round plate 319 with the same form which is provided with twelve through-holes 320 which are placed such that they can be placed in register with the pipes 316 such that the passage area of the channels bounded by these pipes 316 is adjustable through rotation of plate 319.

Connecting to the upper wall 308 are twelve pipes 321 which can link the combustion space 303 to a flue gas discharge 322. The movement of the flue gases is indicated with arrows 323. The pipes 321 extend through the chamber 315.

When the solid fuel carried by the wall 307 is burned, the air blown by the fans 310 through the chambers 313, 314, 315 is warmed on the heated surfaces. As a result of the presence of the clusters of pipes 321, 316 the through-flowing air is in intensive heat transfer contact with the relevant heated walls, which results in very effective heating of the indrawn surrounding air taking place, and in it being possible to achieve a very high yield of the heating device 302.

Situated beneath the lower chamber 313 is an ash pan 324 for collecting the solid combustion products admitted through the holes 320 and the pipes 316. In per se known manner the ash pan displays two adjustable air supply openings 325.

Figure 15:
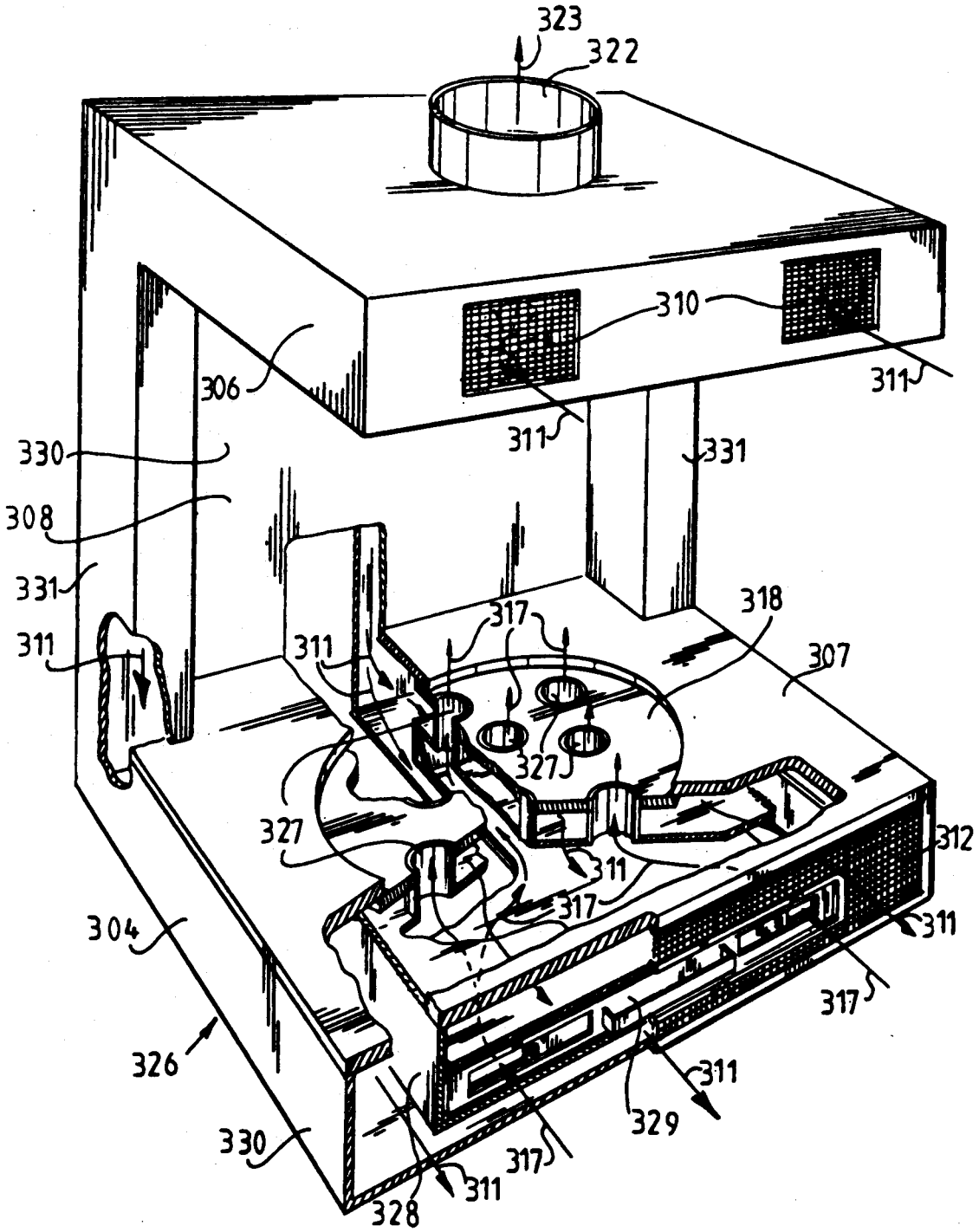
FIG. 15 shows a partly broken away perspective view of another embodiment.

FIG. 15 shows a variant. The heating device 326 shown here likewise comprises a lower wall 307 with a round recessed portion 318. The pipes 327 connecting thereto are ordered however in a different pattern than shown in FIG. 15.

Attached in this embodiment to the bottom surface of the wall 307 is a box-like bearing member 328 for slidable carrying of an ash pan 329. It is noted in this respect that the heating device according to the invention has always to be embodied such that the two flows as according to the respective arrows 311 and 317 are always separated. What must always be avoided is that heated air is lost because it enters the heating space, takes part in the combustion process and is removed at least partially via the discharge with the heat carried by this air. It is also necessary to avoid that heated air blown into the space for heating comprises combustion products, whether they be smoke or combustion gases.

The lower heat exchanger chamber 330 in the embodiment as in FIG. 15 completely encloses the box-like bearing member 328 and the ash pan 329 present therein. This is not the case in the embodiment according to FIG. 14. In the embodiment according to FIG. 15 the box-like bearing member 328 is placed such that a significant amount of air, designated with the arrows 311, heated on the combustion space 303 flows around it.

Attention is drawn to the fact that the standing heat exchanger part 330 in the embodiment as in FIG. 15 also has at the sides two chamber portions 331 extending slightly forwards. This structure contributes to an increased rigidity of the construction and possesses a greater heat exchanging surface area, which further increases the yield of the heating device. It is further noted that the total cross sectional area of the pipes 323 must be at least as great as that of the discharge 322 in order to ensure a good draught.

Figure 16:
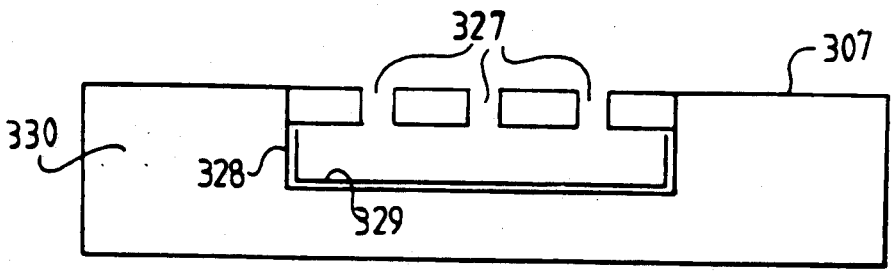
FIG. 16 is a highly schematic cross sectional view of the lower heat exchanger part of the device as in FIG. 15.
Figure 17:
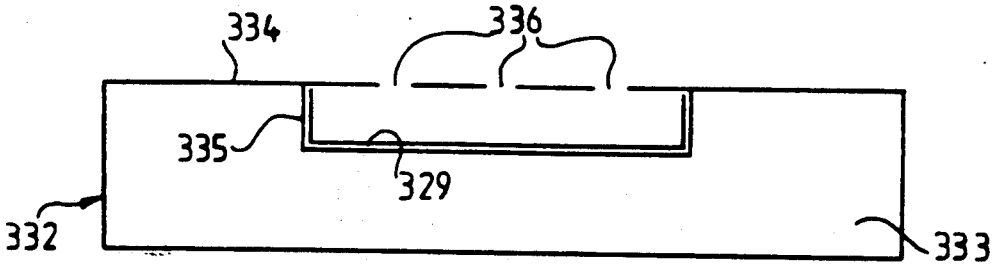
FIG. 17 is a view corresponding to FIG. 16 of an alternative.

FIG. 16 shows in highly schematic form the lower heat exchanger part 304 of the heating device 326 as in FIG. 15. Corresponding components are therefore designated in FIG. 16 with the same reference numerals as in FIG. 15. A comparison is now made between the schematically illustrated embodiment of FIG. 17 and that of FIG. 16. A lower heat exchanger part 332 as in FIG. 17 comprises a lower heat exchanger chamber 333 and an upper wall 334, which is also the bottom wall of a combustion space (not drawn). Analogous to the embodiment according to FIG. 16 the upper wall 334 carries a box-like bearing member 335 for the ash pan 329. At variance with the embodiment of FIG. 16 the interior of bearing member 335 does not connect to the said combustion space via pipes 327 but via through-holes 336 in the upper wall 334. This also ensures a considerable flow of the air heated on the combustion space around the bearing member, just as is the case in the embodiment according to FIGS. 15 and 16.

Figure 18:
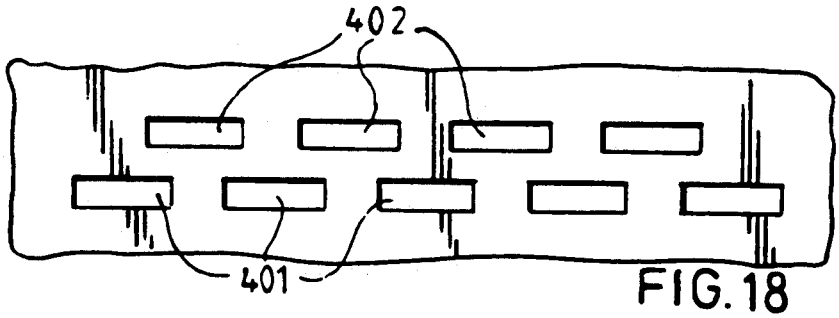
FIGS. 18 and 19 show schematic cross sectional views of configurations of pipes of an upper heat exchanger part.

FIG. 18 shows in schematic form possible forms and a possible configuration of upper heat exchanger pipes. Reference is made as a comparison to for instance FIG. 9, wherein rows of pipes located above one another are placed in staggered position to one another. The pipes 401 of the bottom row and the pipes 402 of the row have a cross section of rectangular form. It will be apparent from FIG. 18 that the projections of the pipes 401 and 402 overlap each other. This ensures a good heat exchange between the combustion gases and the air flowing through pipes 401, 402.

Figure 19:
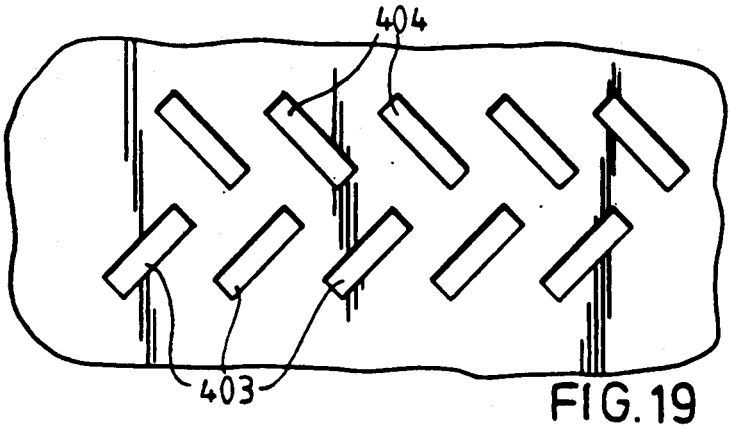

FIG. 19 shows an alternative configuration of bottom pipes 403 and top pipes 404, whereby a comparable, and possibly even better, effect is achieved.

It is remarked that the FIGS. 18 and 19 only show examples. Forms of pipes and their relative positioning in addition to the number rows arranged one above the other can vary from these examples.

Figure 20:
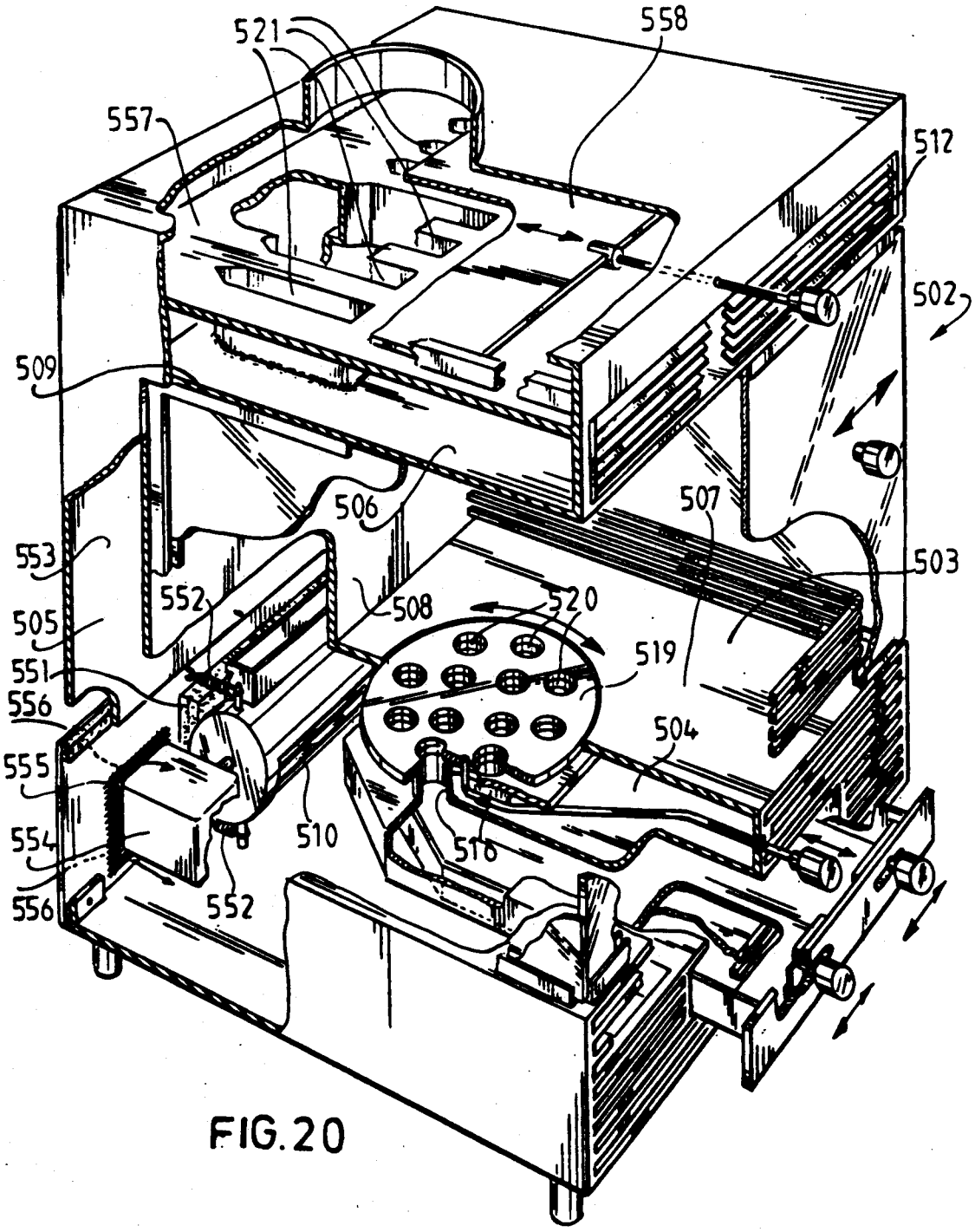
FIG. 20 shows a partly broken away perspective view of a preferred embodiment.
Figure 21:
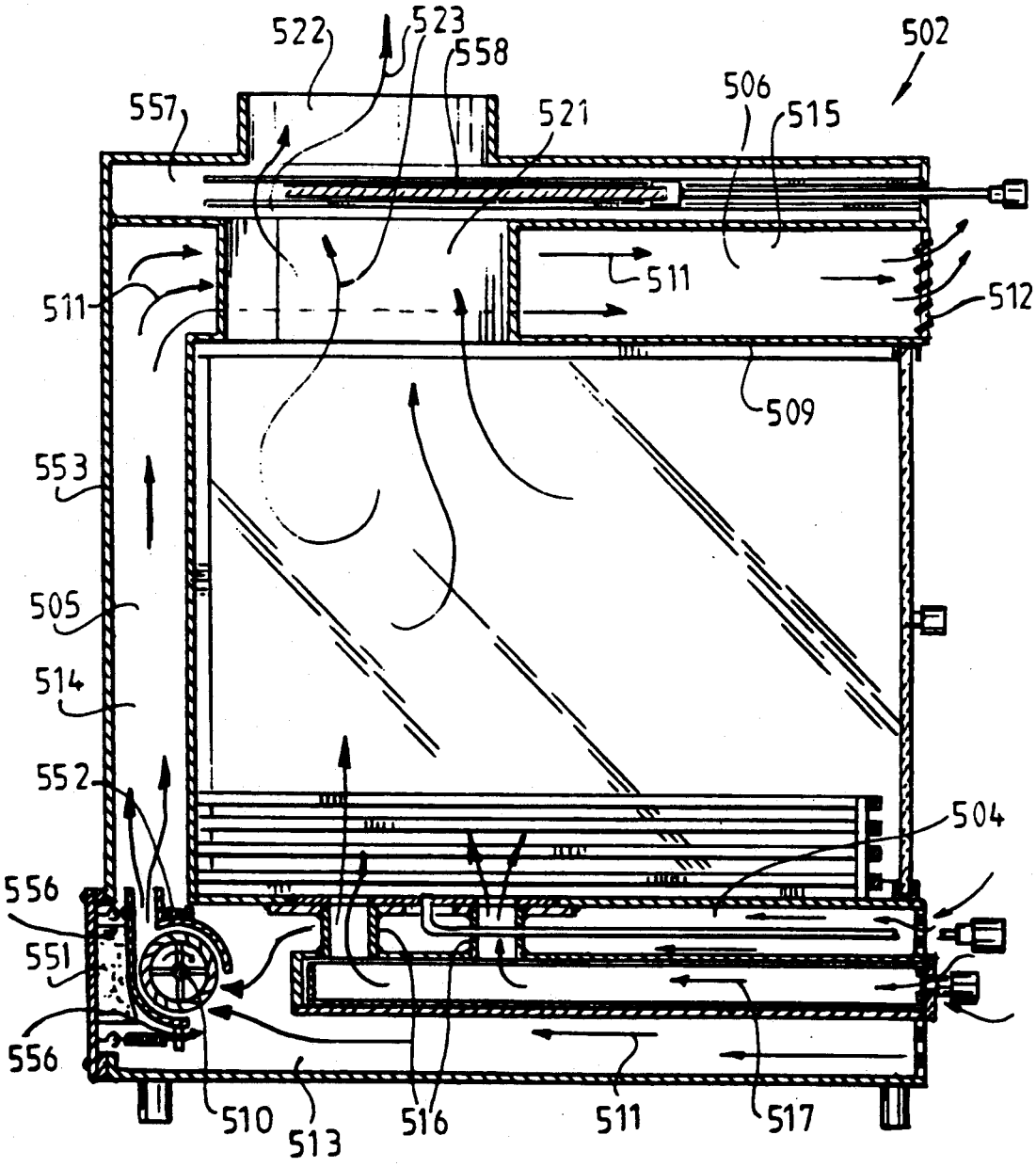
FIG. 21 is a cross section through the heating device according to FIG. 20.

The FIGS. 20 and 21 relate to a preferred embodiment. This embodiment is to some extent analogous to the embodiments according to FIGS. 14 and 15.

FIGS. 20 and 21 show a heating device 502. This comprises a combustion space 503 which is bounded on three sides by a tilted, U-shaped, i.e., C-shaped heat exchanger open to the front having a lower heat exchanger part 504 on which can be laid solid fuel, this lower part 504 connecting onto a standing heat exchanger part 505 which in turn connects onto an upper heat exchanger part 506.

The heat exchanger parts 504, 505 and 506 are each embodied as a chamber with a respective wall 507, 508, 509 continuous to the combustion space 503.

Situated at the point of transition between the lower heat exchanger part 504 and the standing heat exchanger part 505 is a tangential fan 510. As indicated with arrows 511, the indrawn air is blown by the fan 10 successively through the lower heat exchanger part 504, the standing heat exchanger part 505 and the upper heat exchanger part 506, where the then heated air leaves the heating device 502 via a louvred screen 512.

The chambers of the lower part 504, the standing part 505 and the upper part 506 are indicated respectively with 513, 514 and 515.

In this embodiment twelve pipes 516 extend through the chamber 513, connecting the combustion space 503 with the surrounding air for supply of air to the combustion space 503, as indicated with arrows 517. Pipes 516 debouch into a round recessed portion of the wall 507. Lying in that portion 518 is a round plate 519 of the same form which is provided with twelve through-holes 520 which are so positioned that they can be placed in register with pipes 516 such that the passage area through the channels bounded by these pipes 516 is adjustable by rotation of plate 519.

Connecting onto the upper wall 509 are seven pipes 521 which can link the combustion space 503 to a flue gas discharge 522 which can be furnished with bayonet attaching means (not drawn) for coupling to a smoke duct. The movement of the flue gases is indicated with arrows 523. The pipes 521 extend through the chamber 515.

The fan 510 is fastened via a resilient layer and springs 552 to the rear wall 553 of heating device 502. This placing ensures a good damping of the vibrations generated by the electric fan 510, such that they are transmitted in much reduced measure to rear wall 553. The motor 554 of the fan is situated in front of a hole in rear wall 553 that is covered by a grid 555. The air drawn in through the hole, which is shown in FIG. 21 with arrows 556, cools the motor 554 very effectively without however having any adverse effect on the efficiency of heating device 502.

As can be seen in FIG. 20, the pipes 521 display a tapering form in the direction counter to the flow 511. This form is chosen in order to obtain the best possible streamline form of these pipes 521, which results in the air blown out by the fan 510 as according to the arrows 511 encountering a very small flow resistance. A fan of this type is namely capable of displacing large flows of gas, provided the flow resistance to be overcome is very low. Should the flow resistance become greater through the use of pipes of other shape, the yield of heating device 502 will decrease as a result of the increased flow resistance, while there is moreover the danger that the device will start to produce noise.

It is remarked that the louvred screen 12 is detachable and can be placed both such that the blown out air is moved upward and such that it is moved downward, depending on the wish of the user.

Situated above the upper heat exchanger part 6 is a chamber 557 wherein is placed a slide 558 that is operable from outside. Using this trimming slide 558 the draught of the heating device 502 may be controlled within certain limits.

The rest of the construction of the heating device 502 is substantially the same as those in FIGS. 13, 14 and 15. Reference is therefore made in this respect to the discussion thereof.

In the embodiment according to FIGS. 20 and 21 the fan 510 is situated at the point of transition between the lower heat exchanger part 4 and the standing heat exchanger part 5. This fan 510 in the form of a single, tangential fan is thus arranged at a comparatively cool position. Even if the fan is not switched on there is no danger of overheating and consequent damage because partly as a result of the natural draught in the heater 502 the fan 510 is effectively cooled. The passage area of the heat exchanger 504, 505, 506 is everywhere sufficiently great to ensure a negligible flow resistance. This small flow resistance is of importance in ensuring sufficient natural draught through thermosiphon action and is also of essential importance in ensuring that the tangential fan 510 does not emit any audible sound, this being to an increasing extent the case as the flow resistances become greater.

In addition, the fan 510 is arranged, as can be seen in FIG. 20, roughly in the centre between the side walls of the heat exchanger 504, 505, 506. A main air flow extending more or less in the middle of the heat exchanger is in this way ensured, this flow taking heat from along the hottest surfaces of the heat exchanger.

As the fan 510 is of the type that sucks in air and blows it out again at an angle of approximately 90 degrees, guiding of the air round the corner at the point of transition of heat exchanger part 504 to heat exchanger part 505 cannot cause any additional noise-producing turbulence. This is an advantage relative to for instance the embodiment according to FIG. 9, in which a number of possible turbulence, and therefore noise-producing transitions are present.

The embodiment as in the FIGS. 1, 2 and 3 displays a heat resistant plate covering off the bottom of the combustion space at least on its zone adjoining the glass plate such that burning fuel lying on the bottom can give off its flames and combustion products at a distance from the glass plate. Such a heat resistant plate can be incorporated rigidly in the device, for example form the bottom of the lower heat exchanger part, or form part of the device as a loose component. Use of this plate has the advantage that the glass plate is soot-stained less easily by combustion products.

The embodiment in the said figures where the heat resistant plate is connected in the plane in which the glass plate extends with a slight clearance such that this clearance may serve for guiding along this glass plate of an air flow which may optionally be pre-heated, has the advantage that the air flow guided along the glass plate provides a certain cooling of the glass plate, while the chance of soot-staining is also further reduced.

Figure 22:
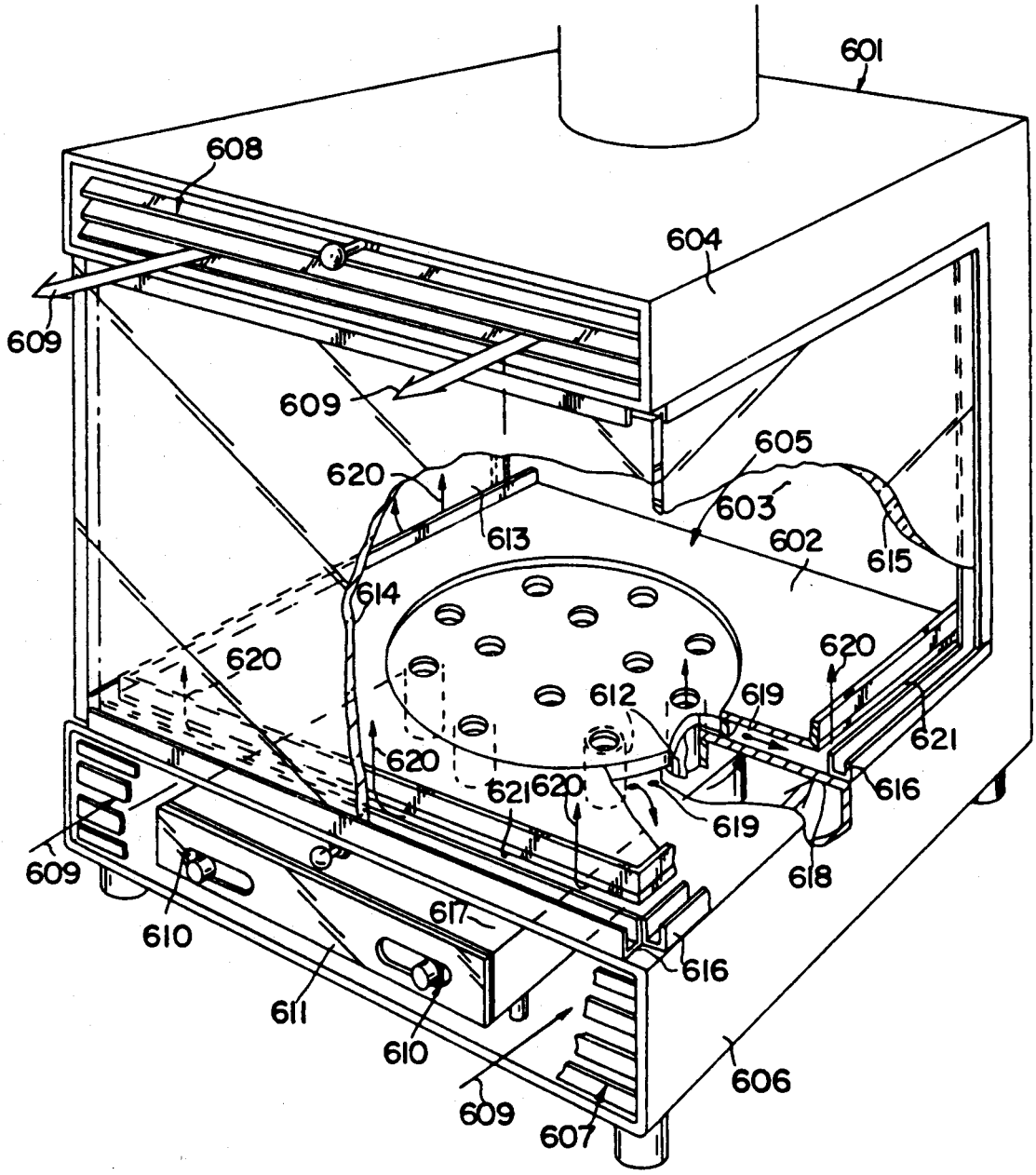
FIG. 22 shows a partly exposed perspective view of another embodiment of the present invention.

Referring to FIG. 22, a heating system 601 is shown. This system includes a combustion space 605 which is bordered on three sides by a forward-opening C-shaped heat exchanger having a lower heat exchanger part 606 with platform 602 which can receive solid fuel as will be explained hereinafter. Lower part 606 connects onto a standing heat exchanger part 603, which in turn connects onto an upper heat exchanger part 604. The heat exchanger parts 602, 603 and 604 are executed as a chamber. They are adjacent to the combustion space 605.

A not-drawn tangential ventilator is located in the passageway between the undermost heat exchanger part 606 and the standing heat exchanger part 603. The ventilator takes air in via the front outlet grid 607 of the undermost heat exchanger part 606 and blows heated air out again through the heat exchanger 606, 603, 604 via grid 608. This air stream is indicated with arrows 609.

Combusion air can enter via air access openings 610 of an ash drawer 611 and can enter the combustion space 605 via twelve tubes 612. These tubes 612 exit into a round hollowed part of the platform 602 in which a round plate of the same shape and twelve plates, to be registered together with the tubes 612, are placed. This permits adjustment of the supply of combustion air to the fuel on platform.

The combustion space 605 is closed on its three free sides by glass plates 613, 614, 615 which are kept in position by U-profiles, all of which are indicated with 616.

The ash drawer 611 is supported by a compartment 617, which is mainly placed freely in the lower heat exchanger part 616.

A plate 618 projects under the platform 602, which forms the top limit of the lower heat exchanger part 606. This plate 618 is equipped with a circle of perforations 619, which thus connect the lower heat exchanger part 606 with the space located between the platform 602 and the plate 618. The air penetrating through the perforations along arrows 609 can thus enter the space. In particular, because of natural convection as a consequence of the high temperature of the platform 602 during the combustion of fuel, the air passing through perforations 619 can be carried along in such a way that it can enter the combustion spaced 605 following the arrows 620 via a free interspace 621 between the edges of the platform 602 and the U-profiles 616. As indicated by the arrows 620, the air pre-heated by the platform 602 brushes past the glass plates 613, 614, 615, accordingly keeping these glass plates effectively soot free.

The glass plates 613, 614, 615 are preferably set as tight as possible in the U-profiles 616, for instance by making use of elastic sealing material, in order to render the described mechanism as effective as possible.

It is also obvious that the perforations 619 can have another shape, for instance groove shaped. Rows of holes can also be used instead of a continuing interspace 621.

It must be pointed out that the dimensions of the different passages involved in the case must be such that sufficient draft is guaranteed under all circumstances.

It seems that the solution presented in Dutch patent application NL-8702919 is not sufficient to avoid an unacceptable soot deposit on the pane by combustion products. Namely, it has appeared that because of the mixture of cold air entering through the interspace with the very hot combustion products, such as soot, and whirling and turbulence occurs in the combustion space that the combustion products still dirty the panes. This gradually reduces the view of the burning fuel from the outside.

This problem is completely solved by the use of heating mechanisms for pre-heating of the air stream, as is now proposed by this embodiment.

One could make use of external heating mechanisms. Nevertheless, the perference is given to a design in which the heating mechanisms are completed as a heat exchanger adjacent to the combustion space which can suck in the cold surrounding air through natural and/or forced convection and can supply it via the interspace alongside the glass plate to the combustion space.

The heating system in a simple execution is characterized by the fact that the platform is part of the heat exchange.

The heat exchanger can be executed for instance as a double-walled construction, or a compartment, of which at least one side is heated. The air passing through it is then heated in a known way through the heated surfaces. Of course, one can also make use of another construction of the heat exchanger. Tubes can for instance be used.

The invention particularly has advantages in case of a heating system that is characterized by the fact that the platform contains a part containing a passage that can be adjusted between zero and maximal value to supply combustion air directly to the combustion space.

By completely or almost completely closing the passage, in combination with an outlet for combustion products if so required, a strong soot deposit on the pane would occur in absence of the mentioned interspace and the mechanisms providing the pre-heated air stream. This will not be the case any longer with the configuration based on the invention.

It also is finally pointed out that the channeling of preheated air alongside the panes according to the invention has the further advantage of making the combustion system safer. It can occur with usual systems that an increased amount of carbon monoxide instead of carbon dioxide is released by the system, especially when the ash drawer is full. This can lead to a dangerous situation as poisonous carbon monoxide enters the outside air. According to the invention, however, there is always an extra air supply in combination with a strong natural draft. This has a consequence not only that the chance for producing carbon monoxide is negligible, but also that all combustion gases are quite effectively carried off to the chimney.

What is claimed is:

1. A heating device with a combustion space having at least one free side, said heating device comprising a substantially C-shaped heat exchanger open to the front for heating air, said heat exchanger being provided with a lower heat exchanger part on which solid fuel can be laid, said lower part connecting onto a standing heat exchanger part that in turn connects to an upper heat exchanger part such that said heat exchanger bounds said combustion space, characterized in that the lower heat exchanger part further comprises a chamber in communication with outside air to be heated and having a wall adjoining the combustion space, through which chamber wall at least one substantially vertical channel extends connecting said combustion space with surrounding air for a supply of air, and supporting means slidably carrying an ash pan having at least one aperture communicating with outside air, said supporting means comprising a compartment with an upper wall in communication with the at least one vertical channel whereby outside air is supplied via the at least one ash pan aperture to the combustion space, said compartment being positioned in the chamber of the lower heat exchanger part such that at least one passage is formed by the ash pan and a wall of the chamber whereby outside air communicating with the chamber is heated by the combustion space and flows at least partially around said compartment to the outside.

2. The heating device according to claim 1, further comprising at least one glass plate which is substantially vertically oriented and bounds the at least one free side of said combustion space, and one passage means communicating a side of the at least one glass plate which faces the combustion space with said at least one passage in said chamber, whereby the heated air is supplied partially to this side of the glass plate to prevent formation of soot and partially to the outside.

3. The heating device according to claim 1, further comprising means for providing outside air to said lower heat exchanger part.

4. The heating device according to claim 3, wherein said providing means comprises a fan.

5. The heating device according to claim 1, further comprising means for drawing cooler outside air into the upper heat exchanger part.

6. The heating device according to claim 5, further comprising means for exiting heated air from the lower heat exchanger part.

7. The heating device according to claim 1, wherein said at least one vertical channel comprises a plurality of apertures located in said lower heat exchanger part and further comprises corresponding apertures located in the upper heat exchanger part, whereby air is directed through the combustion space to improve combustion and produced flue gases are exited from the combustion space.

8. The heating device according to claim 1, further comprising a fan having a motor which is located within said lower heat exchanger part for drawing air through said at least one passage, said standing heat exchanger part further having apertures located in it near the fan which communicate with the cooler outside air, whereby the fan motor is cooled without contacting the flow of heat exchanging air.

9. The heating device according to claim 1, further comprising means for adjusting the at least one aperture of the ash pan between a maximum providing value and no air provided.

10. The heating device according to claim 1, further comprising means for exiting gases produced by combustion.

* * * * *